US006515679B1

(12) United States Patent
Igarashi

(10) Patent No.: US 6,515,679 B1
(45) Date of Patent: Feb. 4, 2003

(54) DRIVING METHOD FOR A LIQUID CRYSTAL DISPLAY DEVICE

(75) Inventor: Yoichi Igarashi, Mobara (JP)

(73) Assignee: Hitachi, Ltd., Tokyo (JP)

( * ) Notice: Subject to any disclaimer, the term of this patent is extended or adjusted under 35 U.S.C. 154(b) by 211 days.

(21) Appl. No.: 09/584,346

(22) Filed: Jun. 1, 2000

(30) Foreign Application Priority Data

Jun. 4, 1999 (JP) ..... 11-158412

(51) Int. Cl.[7] ..... G09G 5/02
(52) U.S. Cl. ..... 345/698; 345/98; 345/99
(58) Field of Search ..... 345/98, 211, 212, 345/213, 99, 204, 600, 698

(56) References Cited

U.S. PATENT DOCUMENTS 5,327,264 A * 7/1994 Iyama ..... 348/210
5,721,570 A * 2/1998 Tsunoda et al. ..... 331/1 R
5,801,678 A * 9/1998 Huang et al. ..... 345/667
6,198,467 B1 * 3/2001 Chiang ..... 345/603
6,219,023 B1 * 4/2001 Kim ..... 345/660
6,271,888 B1 * 8/2001 Lares et al. ..... 348/500

* cited by examiner

*Primary Examiner*—Kent Chang

(57) ABSTRACT

For preventing a screen of a liquid crystal display device from displaying doubly, there is provided a counter for counting a pixels-number N of the display data inputted thereto during one horizontal period, a lateral pixel number generating circuit for generating a capacity number M of pixels in a lateral direction of the screen, a subtracting circuit for calculating a difference of (N−M), a pixels-number conversion circuit for converting the pixels-number N to the number M (M>N), and a clock frequency multiplying circuit for multiplying a frequency CL of the external clock signal supplied thereto by a natural number A being equal to or greater than 2 for an interface circuit thereof, and alters pixel data transferring manner to drain drivers thereof and a frequency of a clock signal transferred to the drain drivers in accordance with the result of the division M/N.

6 Claims, 20 Drawing Sheets

SHD
LCT

LPC1
LCT
SHD

HLD1
HLD3
LPC1
LCT
LPC2
IV
IV
B
II
II
I
I
SHD
AR
WD
A
II
II
HLD2
HLD4

LPC2
LCT
SHD

HLD2
C
CT1
SHD
HLD4

FHL
HOP
FPC2
FGP
AR
POL1
PNL
SUB2
SUB1
IC1
IC2
CT3
FHL
FPC1
EP
FHL
CT4
FHL
CTR4
PCB
CT1
TCON
CTR4
FHL

DRIVING METHOD FOR A LIQUID CRYSTAL DISPLAY DEVICE

BACKGROUND OF THE INVENTION

1. Field of the Invention

The present invention relates to a liquid crystal display device and, more particularly, to the liquid crystal display device being adaptable for multi-scanning operation and being able to display image data without adding a complicated circuit thereto and deteriorating image qualities inputted thereto.

2. Description of the Related Art

So-called flat display panels are generally used for image displaying devices of late years. While many kinds of flat display panels having various operating principles thereof have been developed, liquid crystal display devices are mostly used for image display devices of computer terminals or the like above all.

In an active-matrix type liquid crystal display device having an active element like a thin film transistor in each of pixels thereof and switching the active element thereby, a liquid crystal driving voltage (a gray scale voltage) is applied to each pixel electrode thereof via each active element, so that cross talks between the pixels can be avoided. Therefore, the active-matrix type liquid crystal display device enables multiple-gray shade display thereby without applying such a special driving method thereto that is applied to a simple matrix type (or, a passive matrix type) liquid crystal display device for preventing cross talks from appearing in the simple-matrix type liquid crystal display device.

FIG. 18 is a block diagram for explaining an exemplified structure of the active matrix type liquid crystal display devices. FIG. 19 is a timing diagram for explaining various signal waveforms being supplied to a side of the liquid crystal display device shown in FIG. 18 along a horizontal direction thereof, and FIG. 20 is a timing diagram for explaining various signal waveforms being supplied to another side thereof along a vertical direction thereof, respectively related to a display control thereof.

The liquid crystal display device comprises an interface board on which an interface circuit is mounted. Receiving various control signals including display data (pixel data) and clock signals being supplied from an external circuit (like a main frame of a computer) to the liquid crystal display device TFT-LCD, the interface circuit applies the pixel data, the clock signals (also denoted simply as "clocks", hereinafter), and the other various driving voltages to certain portions of the liquid crystal display device.

The interface circuit has a display control device and a power source circuit therein. The display control device outputs and transmits pixel signals to a first pixel of the liquid crystal display device via data bus DB1, the other pixel signals to a second pixel thereof via the other data bus DB2, clocks D1, D2 to drain drivers being mounted thereon for acquiring the pixel signals into the drain drivers respectively, and a frame starting indication signal FSD and a gate clocks (clock G) to gate drivers being mounted thereon for driving the gate driver, respectively. On the other hand, the power source circuit is constituted by a positive voltage generation circuit PVG, a negative voltage generation circuit NVG, a multiplexer MUX for synthesizing the positive voltage and the negative voltage therein, a counter electrode voltage generation circuit CVG for determining the counter electrode potential, and a gate voltage generation circuit GVG.

A liquid crystal display panel TFT-LCD which constitutes this liquid crystal display device has 1024 pixels juxtaposed along a horizontal direction thereof and 768pixels juxtaposed along a vertical direction thereof. The liquid crystal display panel of this sort belongs to so-called XGA-class being defined by pixel number of 1024×768 thereof. In the interface board for receiving the display data and the control signals sent from the main frame of the computer, red data (R), green data (G), and blue data (B) being received thereat arc divided into groups of two in their respective colors in accordance with every pair of the pixels. For instance, when a red datum, a green datum, and a blue datum corresponding to a first pixel and those corresponding to a second pixel are inputted to the display control device on the interface board as thick arrows in FIG. 18 show, these data arc grouped into a pair of the red data, a pair of the green data, and a pair of the blue data, and then transmitted to the liquid crystal display panel TFT-LCD through respective data buses DB1, DB2 provided for the first and second pixels within a certain period.

The clock signals (also denoted simply as "Clocks", hereinafter) defining the aforementioned certain period and having half frequencies as those for respective pixels are sent from the main frame of-the computer through a clock line shown by a thin arrow of FIG. 18. Concretely, the frequency of the clock becomes 32.5 MHz as a half of 65 MHz.

In a construction of the liquid crystal display panel TFT-LCD, a displaying screen thereof is established as a standard thereof, and drain drivers (TFT-drivers) are disposed in a horizontal direction thereof and connected to drain lines of thin film transistors TFT for supplying voltages for driving liquid crystals to the respective thin film transistors. On the other hand, gate drivers are connected to gate lines thereof so as to supply voltages to respective gates of the thin film transistors TFT during a certain period (one horizontal operation time).

The display control device being constituted by semiconductor integrated circuit (e.g. Large Scale Integrated circuit; LSI) receives display data and control signals sent from the main frame of the computer, and outputs various signals for the two pixels in accordance with the display data and the control signals into the data drivers and the gate drivers. Moreover, the data line for every pixel transmits signal of 18 bits (6 bits for each color of R, G, and B).

A two pixels transmission scheme for transmitting display data for every 2 pixels from the main frame of the computer to the display control device and from the display control device to the drain drivers of the liquid crystal display panel is employed, because the display data cannot be transmitted between the aforementioned apparatuses or the apparatus and the drain drivers by a frequency of 65 MHz as a reference clock for every pixel.

As FIGS. 19 and 20 shows, a pulse for one horizontal sweeping period based on a horizontal synchronizing signal and a display timing signal is supplied to the gate drivers for every horizontal sweeping (horizontal scanning) so as to apply a voltage to a gate of the thin film transistor TFT. A frame starting indication signal based on a vertical synchronizing signal is also supplied to the gate drivers so as to start to display an image at a first line of the liquid crystal display panel TFT-LCD (a group of pixels juxtaposed in a horizontal direction at an end of a screen thereof) for every one frame period.A signal waveform as Clock (from External) in FIG. 19 shows a waveform of the aforementioned clock signal inputted from an external circuit (e.g. a main frame of a computer) to the liquid crystal display device thereto.

The positive voltage generation circuit, the negative voltage generation circuit, and the multiplexer being provided in the power source circuit invert directions of electric fields applied to certain liquid crystals for every certain period direction so as to prevent an electric field having a certain direction from being applied to the certain liquid crystals continuously for a long time (Alternation of the liquid crystal driving voltage). The alternation of the liquid crystal driving voltage in this explanation is performed by changing voltages supplied to the drain drivers at either a positive side or a negative side of a counter electrode voltage as a reference for every predetermined period. In this explanation, the alternation is performed in accordance with every frame period. Timings for reversing a polarity of the liquid crystal driving voltage arc controlled by a alternation timing signal ATS supplied from the display control device to the power source circuit.

SUMMARY OF THE INVENTION

In the thin film transistor type liquid crystal display device of the aforementioned conventional technology, pixel data acquisitions of the drain drivers (latch-operations of the drain drivers in accordance with the pixel data) have to be finished within one line sweeping period (one line time), and all of the lines have to be operated within the one frame period. Therefore, when a number of the pixel data being inputted to the liquid crystal display device is smaller than that of display pixels thereof and either the one line sweeping period or the one frame period thereof are apparently insufficient for those required for displaying the inputted pixel-number in response to the predetermined clock frequency, the display control device operates erroneously and the control signals cannot be generated properly.

FIG. 21 is an explanatory diagram showing an example of doubly displaying, state appearing on a screen of the conventional liquid crystal display device. If the control signal cannot be generated as mentioned above, pixel data being inputted into a normally operating region of the liquid crystal display device are displayed in other region thereof where the liquid crystals are not driven and the other region which is short of display signals being inputted to the region in a horizontal direction thereof or in a vertical direction thereof. In FIG. 21, in contrast to the displaying area DA in which the display data inputted thereto are normally displayed (as exemplified by an arrangement of letters for every pixel), a black displaying area BAH in accordance with a horizontal retrace period, and a black displaying area BAV in accordance with a vertical retrace period, foreparts of the displaying contents being displayed in the displaying area DA are also displayed in areas denoted as DAHD (Doubly displaying area in a horizontal direction) and DAVD (Doubly displaying areas in a vertical direction), respectively. Such a state that at least a part of the display contents is reproduced and displayed in parallel with each other in a screen of the liquid crystal display panel is called "Doubly displaying state", and affects a displaying screen thereof.

An objective of the present invention is to solve the aforementioned problems and to provide a method for driving a liquid crystal display device suitable to complete each pixel operation and to provide clear images, even if displaying periods of the display data inputted by simple circuitry are insufficient.

For achieving the aforementioned objectives, the present invention utilizes a faster clock signal than that inputted to the liquid crystal display device from an external circuit thereto (e.g., the main frame of the computer) to complete respective operations of the drain drivers being disposed in a horizontal direction (a lateral direction) of the liquid crystal display panel in a short time (e.g. one line time). An oscillator based on a phase-locked loop (PLL) is used for generating the faster clock signals. However, if the faster clock signals are excessively fast, processing at the drain driver will be finished before the displaying periods is up. Therefore, it is preferable for a method for driving a liquid crystal display device according to the present invention to determine whether a clock signal to be outputted from the display control device should be locked in a state as the clock signal is inputted thereto (keeping the clock frequency as that of the inputted state), or changed faster than the inputted state (multiplying the clock frequency higher than that of the inputted state), in accordance with the situations of displaying data period, the vertical retrace period, or else.

As for driving the gate drivers being disposed in a vertical direction (a longitudinal direction) of the liquid crystal display panel, all of lines juxtaposed longitudinally therein have to be scanned (driven) within the one frame time. This operation can be realized by scanning a plurality of the lines simultaneously during the one line. For this operation, a number of the lines being driven simultaneously should be determined in accordance with the displaying datum period or a condition of the vertical retrace period.

The representative configurations of a method for driving a liquid crystal display device structures according to the present invention will be described as follows.

Configuration 1: In a liquid crystal display device comprising a liquid crystal display panel having a plurality of pixels arranged in a matrix manner each of which has an active matrix clement, a plurality of drain drivers for applying voltages based on a plurality of display data corresponding to a group of the plurality of the pixels arranged in a lateral direction of the matrix respectively to the group of the pixels, and a plurality of gate drivers for applying a scanning voltage to each of another group of the plurality of the pixels arranged in a longitudinal direction of the matrix, the liquid crystal display device further comprises an interface board on which an interface circuit for generating displaying voltages to be applied to the plurality of the drain drivers and the plurality of the gate drivers in accordance with the plurality of the display data and a control signal supplied from an external circuit to the liquid crystal display device (e.g. a main frame of a computer) is mounted, the interface circuit includes a counter for counting a number N of pixels of the display data being inputted from the external circuit during one horizontal period, a lateral pixel number generating circuit for generating a number (a capacity, or a quota) M of pixels arranged in a lateral direction of the liquid crystal display panel which defines a number of the image data acceptable in the lateral direction, a subtracting circuit for subtracting the number M from the number N (calculating a difference of the (N−M)), a pixels-number conversion circuit for converting the number N of pixels of the display data to that of the number M (in the case of M>N), and a clock frequency multiplying circuit for multiplying a frequency CL of the clock signal supplied from the external circuit by a number of A (A is a natural number equal to or greater than 2).

The number N of the pixel data (included in the image data, mentioned above) arc converted to the number M thereof (M>N) using the clock signal of the frequency multiplied A-times by the clock frequency multiplying circuit using the liquid crystal display device constituted as mentioned above, by employing one of following methods (1)–(3).

Method (1): The pixel data are transferred together with the clock signal having a frequency of A×CL obtained by multiplying the frequency CL by the number A to the drain drivers if the M/N is divisible and provides the A as a quotient of the division.

Method (2): The pixel data are transferred together with the clock signal having the frequency CL (as inputted from the external circuit) to the drain drivers, while the clock signal having a frequency of A×CL obtained by multiplying the frequency CL by the number A to the drain drivers for scanning the rest (M–N) pixels (to which the pixel data are not transferred) of the liquid crystal display panel, if the M/N is indivisible.

Method (3): Data for displaying a plain region (e.g. a black displaying region) to are transferred together with the clock signal having a frequency of A×CL obtained by multiplying the frequency CL by the number A to the drain drivers, if the M/N is indivisible and a product of the N being multiplied by the A is smaller than M (i.e. A×N<M).

According to this configuration, multiple scanning processing can be performed by the liquid crystal display panel without the doubly displaying in a horizontal direction thereof.

Configuration 2: In the liquid crystal display device having the configuration 1, wherein a number of pixel lines (each of which is constituted of a group of pixels juxtaposed in the lateral direction of the liquid crystal display panel) arranged in a longitudinal direction of the liquid crystal display panel is M0, a number of pixel lines of the display data being inputted to the interface circuit is N0, and the number M0 is greater than the number N0 (i.e., M0>N0), the liquid crystal display device is driven by one of following methods (4)–(6).

Method (4): A0 rows (A0 is a natural number equal to or greater than 2) of the pixel lines in the liquid crystal display panel from the first line to the A0-th line thereof are scanned simultaneously during one line time, and next A0 rows of the pixel lines from the (A0+1)-th line to the 2A0-th line thereof are scanned simultaneously during in next one line time (after the one line time), if the M0/N0 is divisible and provides the A0 as a quotient of the division.

Method (5): The display data are scanned by every row of the pixel lines during a display period (a scanning period), and data for displaying a plain region (i.e. a black displaying region) are scanned by B lines simultaneously in the vertical retrace period so as to finish scanning (M0–N0) rows of the pixel lines of the liquid crystal display panel within the vertical retrace period, if the M0/N0 is indivisible and provides the number B as a remainder of the division.

Method (6): The display data are scanned by every C rows (C is a natural number equal to or greater than 2) of the pixel lines during a display period (a scanning period), and data for displaying a plain region (i.e. a black displaying region) are scanned by B lines simultaneously in the vertical retrace period so as to finish scanning (M0–N0) rows of the pixel lines of the liquid crystal display panel within the vertical retrace period, if the M0/N0 is indivisible and a product of the number N multiplied by the number C is less than the number M (i.e., C×N<M).

According to this configuration, multiple scanning processing can be performed without doubly displaying in either a horizontal direction or a vertical direction of the liquid crystal display panel.

As a circuit for generating fast clock signals can be constituted on a basis of a phase-locked loop (PLL) without either special technique, a plurality of lines of the liquid crystal display panel can be driven synchronously (simultaneously) by simply combining the circuit with a special-purpose driver thereof without any other circuitry. Moreover, resolution will be determined easily by obtaining the resolution of the display data inputted to the liquid crystal display device using the display timing signals.

Incidentally, the present invention is not limited to any of the above-described structures, and it goes without saying that various modifications can be made without deviating from the technical ideas of the present invention.

These and other objects, features and advantages of the present invention will become more apparent from the following description when taken in conjunction with the accompanying drawings.

BRIEF DESCRIPTION OF THE DRAWINGS

FIG. 12A shows a front view thereof, FIG. 12B shows a left side view thereof, FIG. 12C shows a right side view thereof, FIG. 12D shows an upper side view thereof, and FIG. 12E shows a lower side view thereof, respectively;

FIG. 14A shows a cross-section taken along a line I—I in FIG. 12A, FIG. 14B shows a cross-section taken along a line II—II in FIG. 12A, respectively;

FIG. 15A shows a cross-section taken along a line III—III in Fig.12, and FIG. 15B shows a cross-section taken along a line IV—IV in FIG. 12A, respectively;

FIG. 16A shows a lower side view of the liquid crystal display panel, and FIG. 16B shows a left side view thereof, respectively;

DETAILED DESCRIPTION

Figure 18:
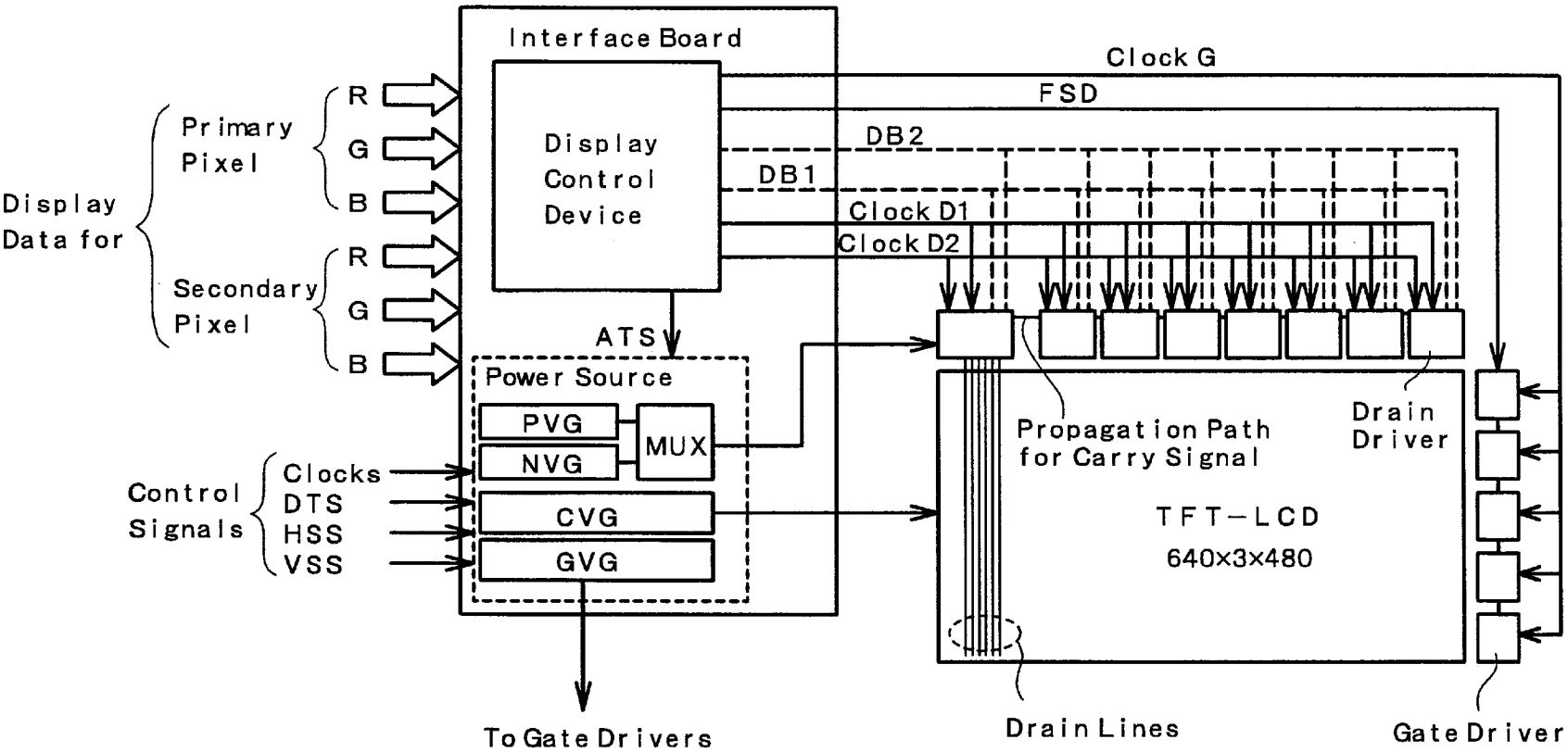
FIG. 18 is a block diagram for explaining an exemplified structure of the active matrix type liquid crystal display devices.
Figure 19:
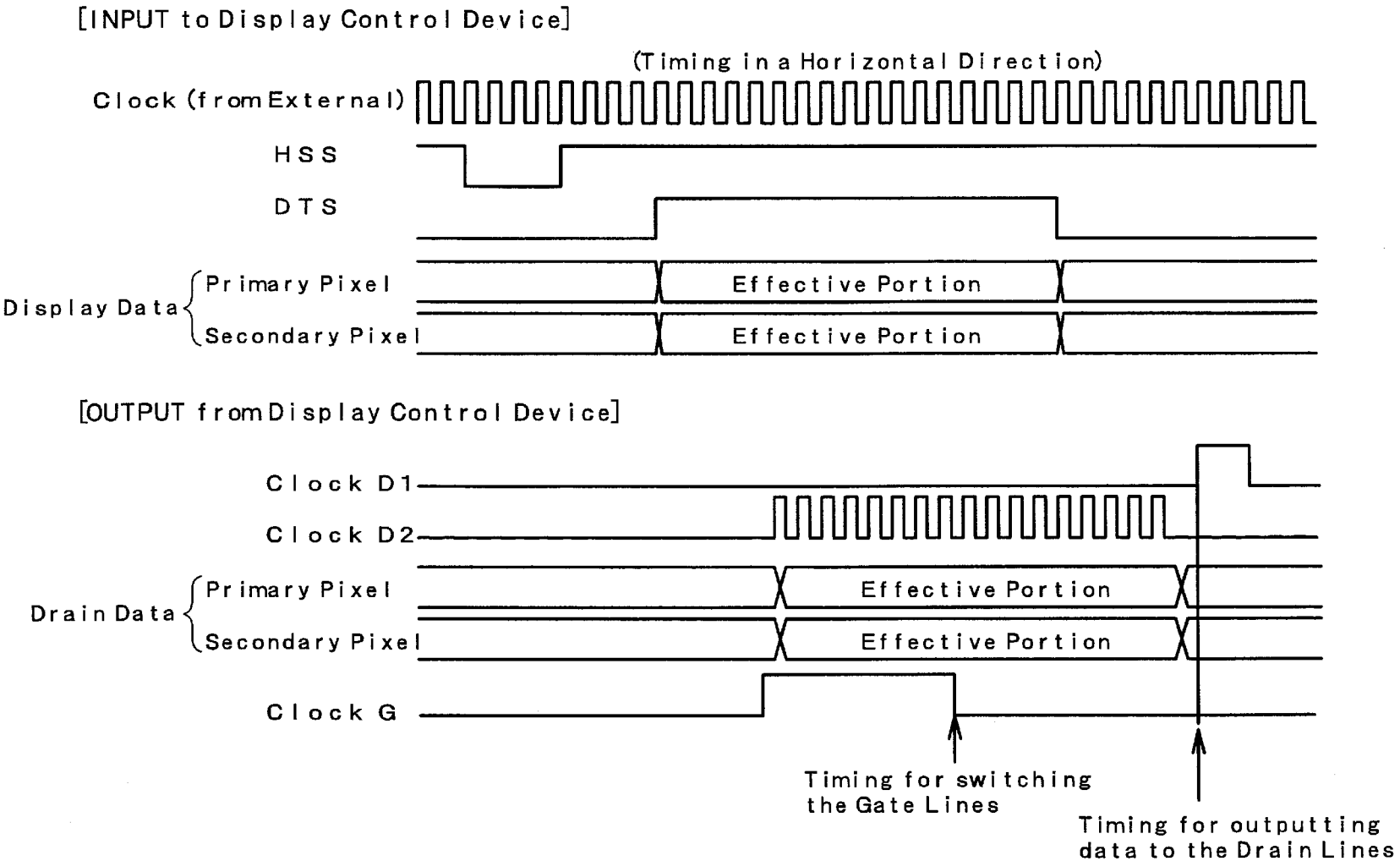
FIG. 19 is a timing diagram for explaining various signal waveforms being supplied to a side of the liquid crystal display device shown in FIG. 18 along a horizontal direction thereof.
Figure 20:
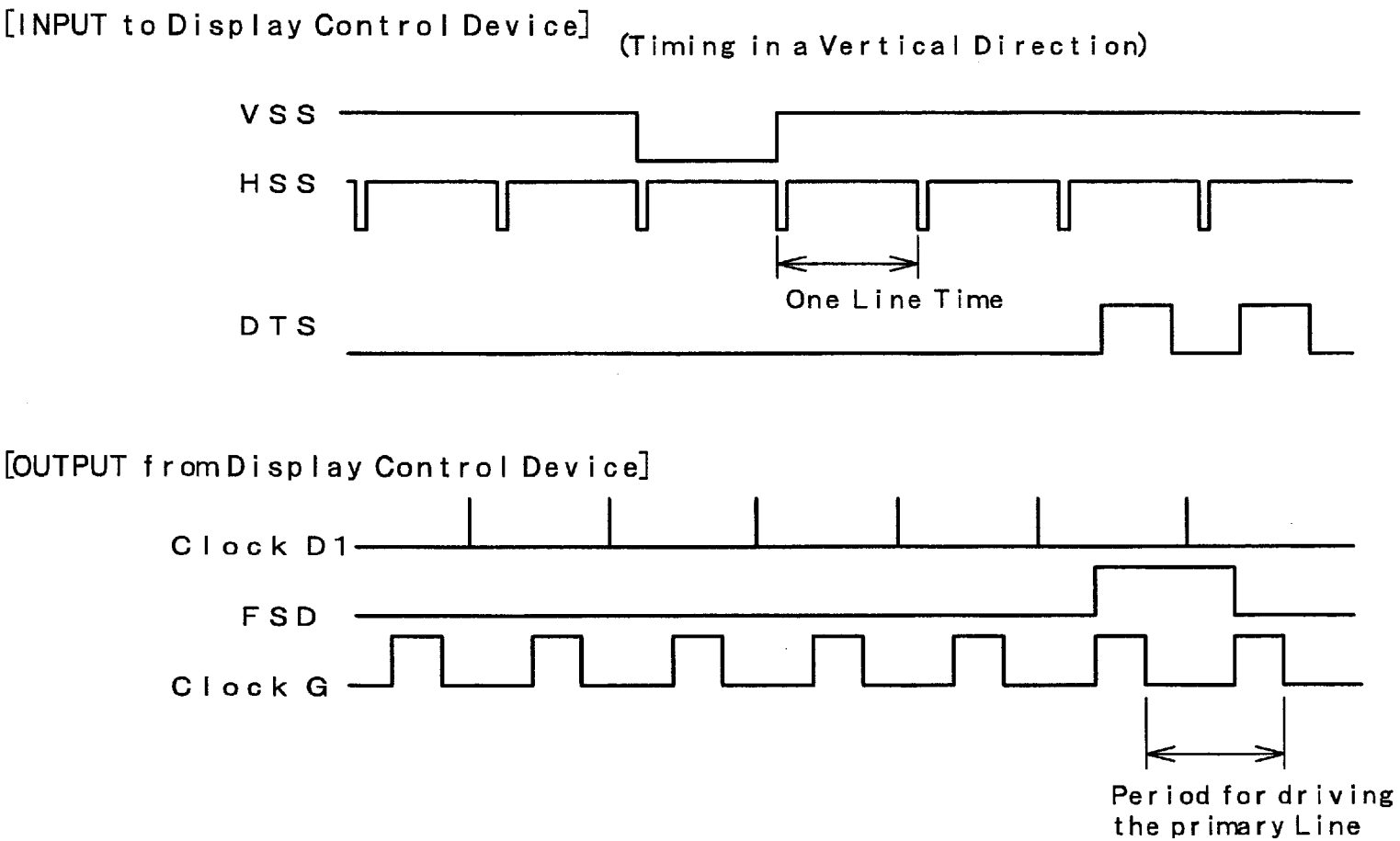
FIG. 20 is a timing diagram for explaining various signal waveforms being supplied to another side thereof along a vertical direction thereof, respectively related to a display control thereof.
Figure 21:
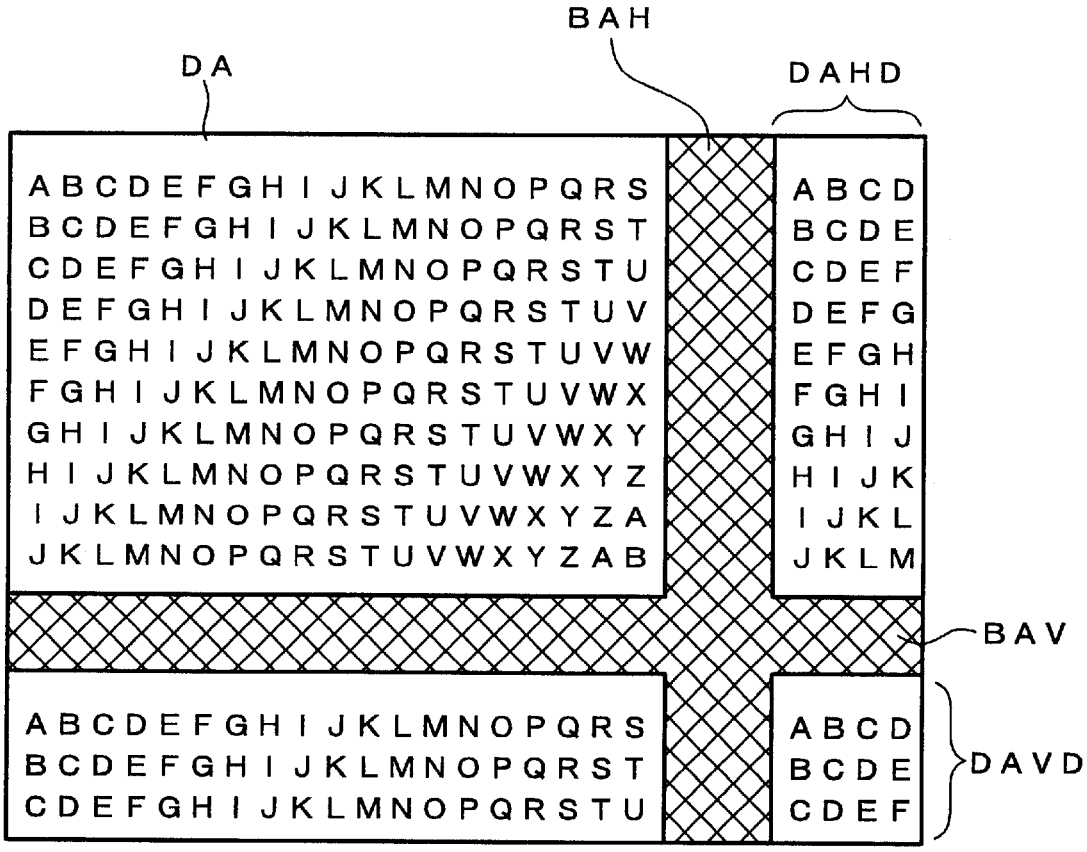
FIG. 21 is an explanatory diagram showing an example of doubly displaying state appearing on a screen of the conventional liquid crystal display device.

An embodiment of the present invention will be described below in detail with reference to drawings of the embodiment. As the liquid crystal display device to which the present embodiment is applied is similar to that being explained previously in reference to FIG. 18, explanations overlapping those described previously are omitted.

Figure 1:
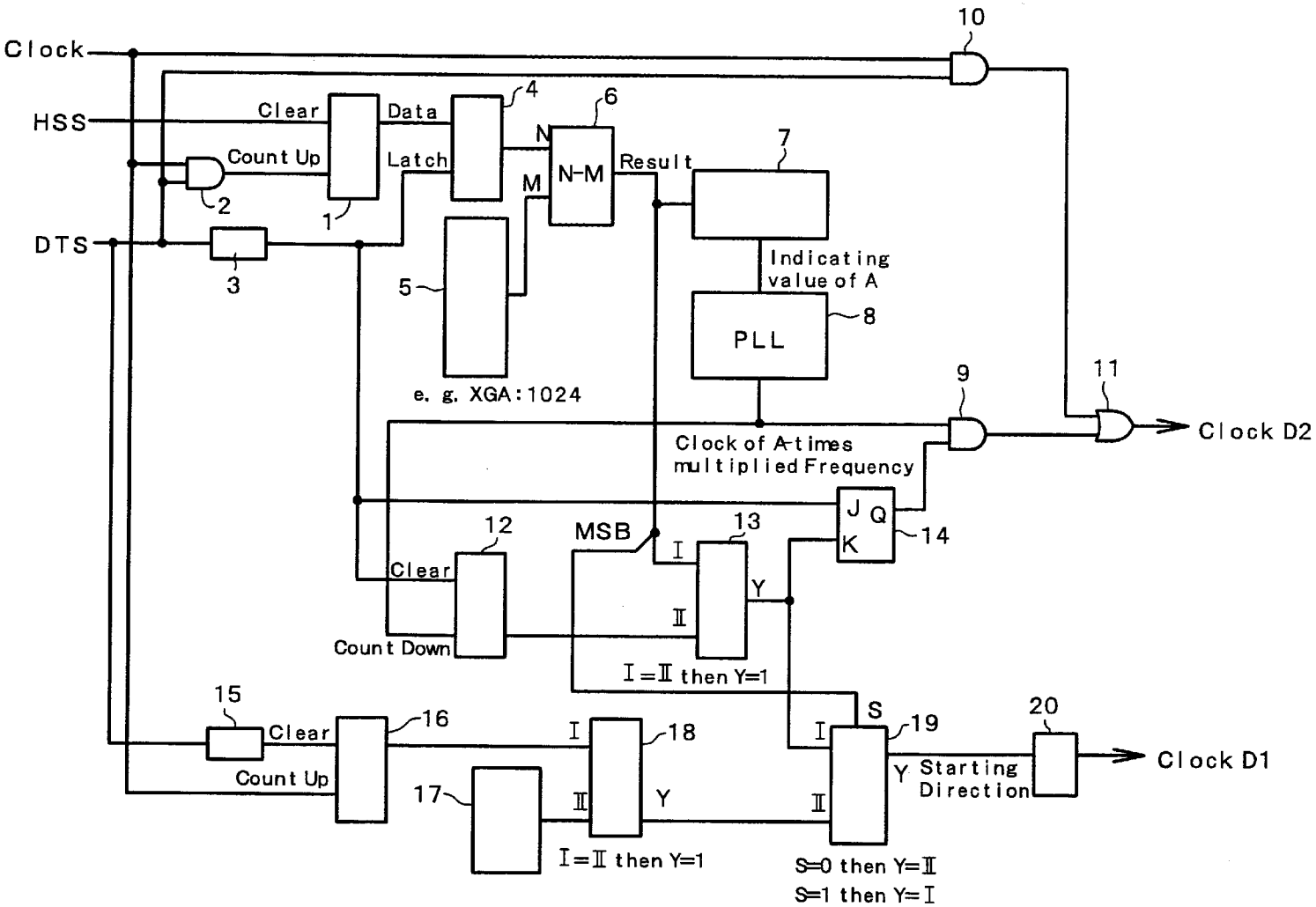
FIG. 1 is a block diagram of circuitry for processing in a horizontal direction of the liquid crystal display devices according to the present invention for explaining a configuration of an embodiment thereof.
Figure 2:
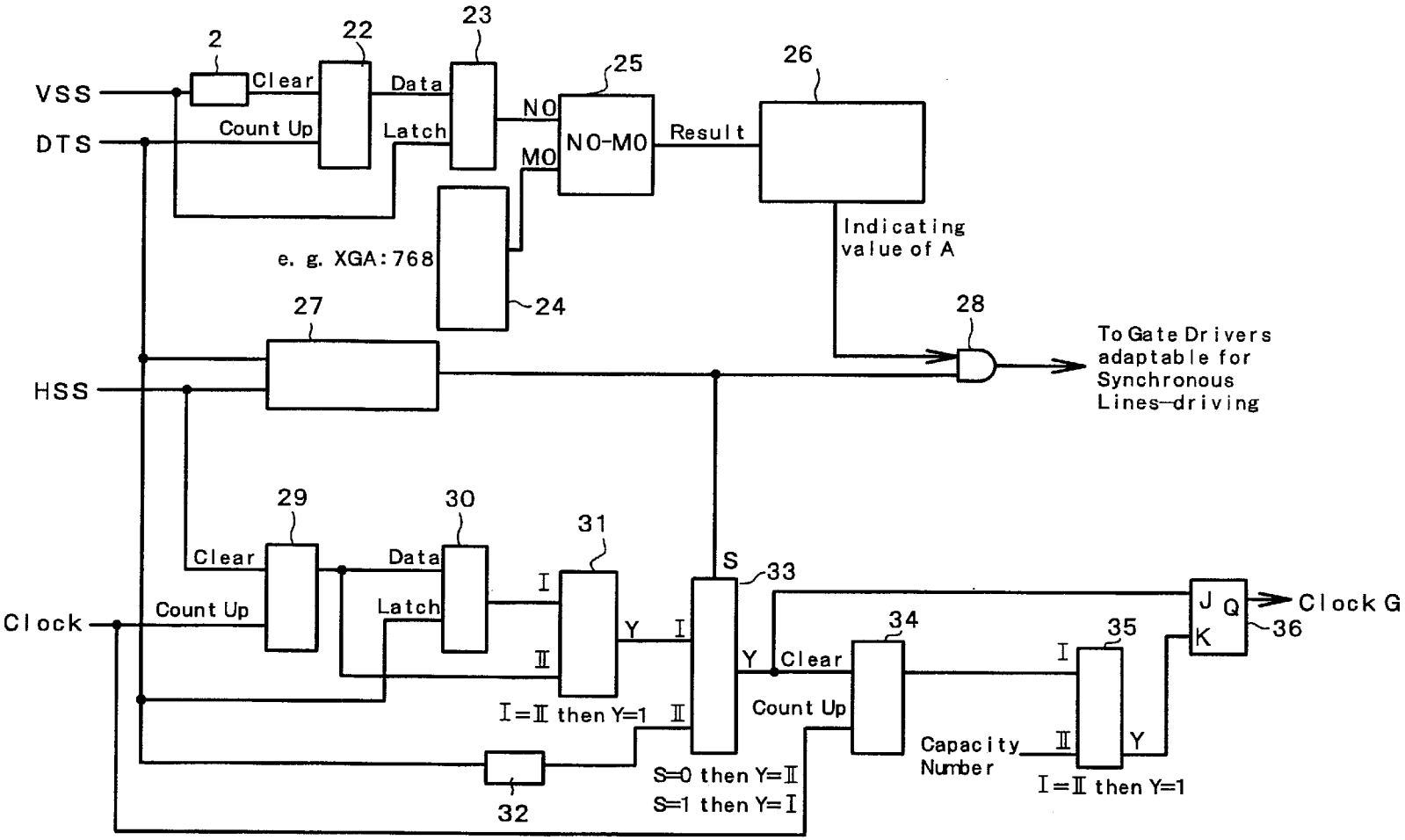
FIG. 2 is a block diagram of circuitry for processing in a vertical direction of the liquid crystal display devices according to the present invention for explaining a configuration of an embodiment thereof.

FIGS. 1, 2 arc block diagrams for explaining configurations of an embodiment of the liquid crystal display device according to the present invention, and FIG. 1 shows circuitry for processing in a horizontal direction thereof (signal processing related to drain drivers arranged in the horizontal direction) and FIG. 2 shows circuitry for processing in a vertical direction thereof (signal processing related to gate drivers arranged in the vertical direction).

In FIG. 1, a reference clock signal (denoted as "Clock") being inputted from an external side to the liquid crystal display device (a main frame side of a computer, in this embodiment, at a left side of FIG. 1 but not shown) is applied to logical gates 2, 10, and a counter 16. A horizontal synchronizing signal HSS as a clearing signal of a counter 1 is inputted to a clear terminal of the counter 1, and then counts up the clock in response to a display timing signal DTS.

Counted data of the counter 1 are inputted to a register 4, and then latched thereby in response to a fall of the display timing signal DTS. The fall of the display timing signal DTS is detected by a signal fall detecting circuit 3.

A lateral pixels number generating circuit 5 generates a capacity number of M in accordance with a specification of the liquid crystal display panel (e.g., M=1024, if the liquid crystal display panel belongs to the XGA-class). The value of M is a number of pixels juxtaposed in a line along a lateral direction of the liquid crystal display panel, and means an upper limit of pixel data allowed to be inputted to the line (a capacity of the line). A subtracting circuit 6 subtracts M from N, and if the difference of (N−M) is negative, a multiplication decision circuit 7 will be activated to decide a multiplication factor of A in accordance with a result of the subtraction. The multiplication decision circuit 7 is effective while the (N−M) is negative (MSB=1), and a multiplication factor for multiplying a frequency of the clock signal being sent to the drain drivers arc determined in accordance with a result of a division of (M/N).

By supplying the multiplication factor of A to a multiplied clock frequency generation circuit (PLL) 8, the clock signal is accelerated by the A-times (the frequency of the clock signal is multiplied by the A-times). The clock signal having A-times multiplied frequency passes through the logic gates 9, 11, and then becomes a clock D2. When the display timing signal does not rise, the clock signal from the main frame of the computer is supplied to the drain drivers through the logic gate 11.

On the other hand, the counter 12 is cleared (reset) at a time which the display timing signal DTS rises, and a countdown of the clock signal having the A-times multiplied frequency is started. When a remainder I of the subtracting circuit 6 becomes equal to a countdown value II of the counter 12, a comparator circuit 13 provides a reset signal by outputting a "1" from an Y output thereof for an K input of a J-K flip-flop circuit 14, and then terminates the outputs of the clock signals D2 by closing the logic gate 9.

As a signal rise detecting circuit 15 detects a rise of the display timing signal DTS, the signal rise detecting circuit 15 clears (resets) a counter 16 and makes the counter 16 start to count up the clock signals (Clock) from the main frame of the computer. A counting result I of the counter 16 is applied to the comparator circuit 18, and then is compared with an intrinsic capacity number II of the liquid crystal display panel (pixels number for displaying image provided for the liquid crystal display panel) outputted from a capacity number generation circuit 17 in the comparator circuit 18.

If I equals to II, an output of the comparator circuit 18 is inputted to a multiplexer 19 and compared with the input S of the subtraction result MSB of the subtracting circuit 6. When the MSB value S is "0", an Y output becomes the II. On the other hand, when the MSB value S is "0", an Y output becomes the I to starts a pulse generation circuit 20 for clock signals D1; and the pulse generation circuit 20 outputs the clock signal D1 generated therein.

In this configuration, a number of the pixels of the display data in the horizontal direction is determined in accordance with clock periods (clock numbers) of the display timing signal DTS to be inputted, and if the pixels numbers of the display data is smaller than a resolution (a number of pixels provided) in a lateral direction of the thin film transistor (TFT) type liquid crystal display device, a difference between the pixel numbers to be displayed and the resolution is determined and then the multiplication factor for the clock frequency corresponding to the difference is selected. When the display data are transferred from the display control device to the drain drivers, both the clock signals and the display data being inputted to the display control device are sent to the drain drivers as long as the display timing signals DTS are inputted thereto.

In the case for displaying signals (display data) of e.g. the VGA-class (640×480 pixels) in a screen of the liquid crystal display device of e.g. the SXGA-class (1280×1024 pixels), according to the relationship of $$M/N=1280/640=2=A, \text{ as a quotient,}$$

the display data is transferred to the drain drivers on a basis of the clock signals having twice multiplied frequency of the clock signal CL inputted from the main frame of the computer.

On the other hand, according to the relationship of $$M'/N'=1024/480=2=A' \textit{ as a quotient, } \ldots 64=B \text{ as a remainder,}$$

a pair of the lines are selected synchronously (simultaneously) during the displaying period. For the 64 lines left in the screen, every one line or every two lines simultaneously is selected.

During a period (called, a horizontal retrace period) when the display timing signals arc not inputted, the clock having a multiplied frequency and the display data for displaying black (border color) arc sent to the drain drivers. Sending the data the total of which is equivalent to the resolution in the lateral direction of the liquid crystal display device, then the clock signals D1 are outputted. Thereby, a multiple scanning (multi-scan) process in the horizontal direction is completed without causing the doubly displaying.

On the other hand in FIG. 2, the display timing signal DTS inputted from the external circuit to the liquid crystal display device (e.g. the main frame of the computer at the left side of FIG. 2, but not shown) is counted up by a counter 22. A result of the count up process is cleared (reset) by a vertical synchronizing signal VSS which is inputted to the counter 22, delayed by a pulse delay circuit 21, and outputted from the pulse delay circuit 21. A count up signal of the counter 22 is latched by a register in accordance with the vertical synchronizing signal VSS.

A longitudinal pixels number generating circuit 24 generates a capacity number of MO in accordance with a specification of the liquid crystal display panel. The value of M0 is a number of pixels juxtaposed in a column along a longitudinal direction of the liquid crystal display panel, and means an upper limit of pixel data allowed to be inputted to the column (i.e. a column capacity). In the case of the liquid crystal display device of the XGA-class, the longitudinal pixel number M0 is 768. A subtracting circuit 25 subtracts an output M0 of the longitudinal pixels number generating circuit 24 from a latching value N0 of the register 23. A subtraction result of the subtracting circuit 25 is inputted to a driving lines number decision circuit 26 for deciding a number of lines driven during the vertical retrace period. If the difference of(N0−M0) is negative (MSB=1), the driving lines number decision circuit 26 will be activated (become effective) to decide a line number of A0 in accordance with a quotient A0 of a division of (M0/N0), and to output the line number of A0 to gate drivers adaptable for driving the lines synchronously (simultaneously) through a logic gate 28.

If the display timing signal DTS is not inputted during a certain one line time, a vertical retrace period decision circuit 27 recognizes the certain one line time as a vertical retrace period, and if the display timing signal DTS is inputted again during another one line time after the certain one line time, the vertical retrace period decision circuit 27 recognizes the another one line time as a display period. The logic gate 28 is switched in accordance with the decision results of the vertical retrace period decision circuit 27, and is turned on to indicate a value of A0 for the gate drivers during the display period.

The counter 29 being cleared by the horizontal synchronizing signal HSS counts up the clock signals (Clock) from the main frame of the computer, and latches a number of the clock signals between the horizontal synchronizing signals as data in the register 30. The latching operation is controlled in accordance with the display timing signals DTS.

The latched data I of the register 30 are inputted to the comparator circuit 31, and then compared with counting outputs II of the counter 29. If the I equals to the II in this comparison, a Y output of the comparator circuit 31 will be "1" and applied to a multiplexer 33 as an input I. Receiving the input I and an input II in response to a rising edge of the display timing signal DTS detected by a signal rise detecting circuit 32, the multiplexer 33 provides the II for S=0 and the I for S=1 as an output Y thereof, and applies it to a clear-input of a counter 34. The multiplexer 33 also provides a J input for a J-K flip-flop 36, and supplies the driving clock of the gate drivers (Clock G) to the gate drivers.

The counter 34 counts up the clock signal (Clock) from the main frame of the computer, and applies counting data I to a comparator circuit 35. The comparator circuit 35 compares the counting data I and a capacity number II, and then supplies an output Y=1 to a K input of the J-K flip-flop 36 if the I equals to the II.

In this configuration, a resolution (a number of lines) in a longitudinal direction is determined with reference to an input number (a number of pulses) of the display timing signals within one frame period, and a displaying operation is started by selecting (scanning) every one line during the display period if the input number is smaller than a number of lines for the displaying images juxtaposed in a longitudinal direction of the liquid crystal display panel.

The gate driver is directed by a signal to be sent thereto that the gate driver selects a plurality of lines synchronously (simultaneously) during a no-display period, i.e. the vertical retrace period so as to scan whole lines within the one frame period. One of the gate drivers being adaptable for selecting a plurality of lines synchronously is a product of HD66321 (Hitachi, Ltd.).

Moreover, if a number of display pixel lines being inputted is 1/A0 (a reciprocal of the value of A0) of the number of lines for displaying images of the liquid crystal display panel, the liquid crystal display panel can be adapted to display an enlarged image by setting a line number to be scanned for every scanning step (e.g. every line time) to a value of A0.

Figure 3:
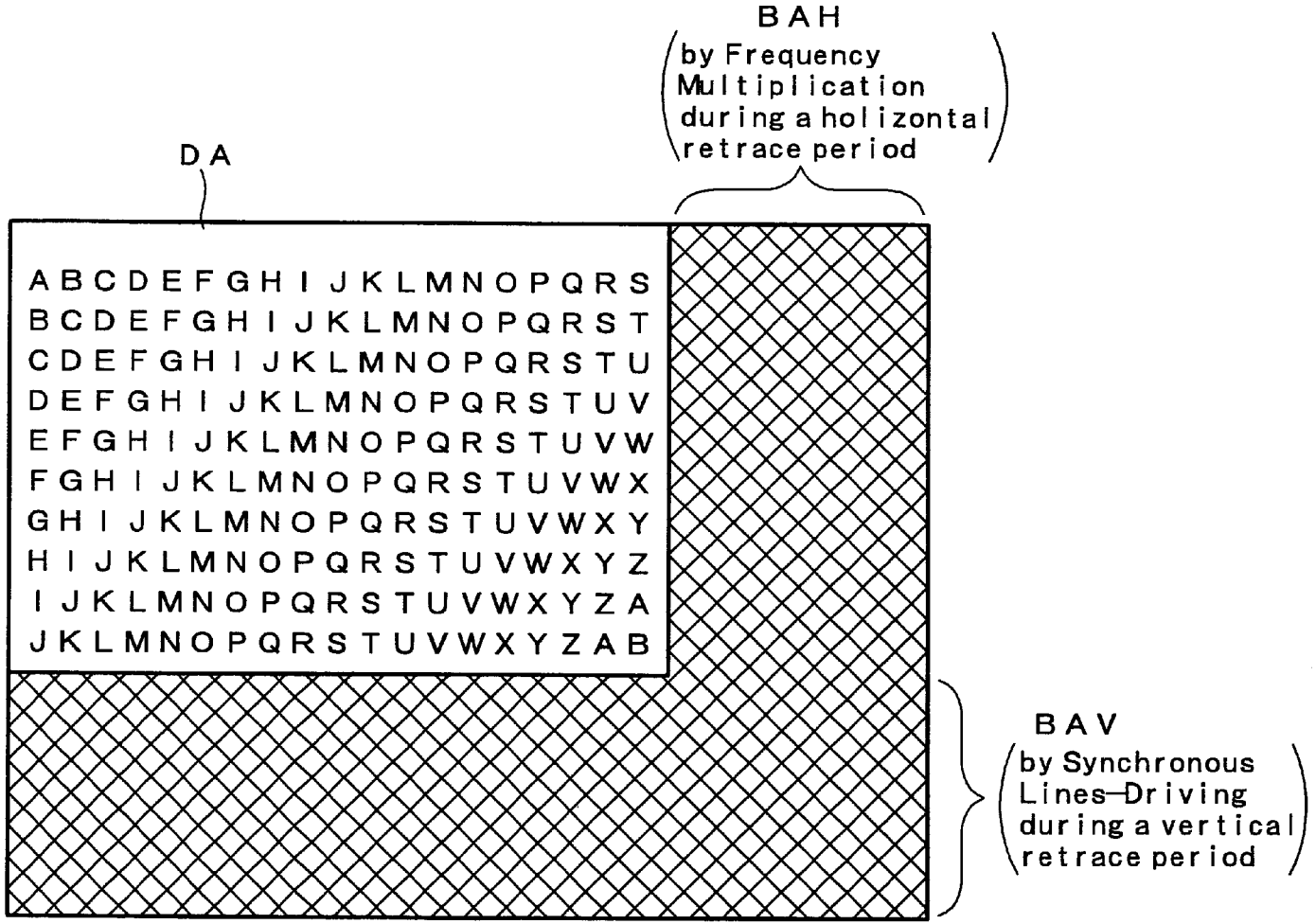
FIG. 3 is an explanatory drawings showing an example of contents being displayed in a screen of the liquid crystal display panel based on the processing of the embodiment of the present invention.

FIG. 3 shows an example of contents being displayed in a screen of the liquid crystal display panel based on a processing of the embodiment according to the present invention. A display area for the display data DA, a black-displayed area by a clock frequency multiplication during the horizontal retrace period BAH, and a black-displayed area by a clock frequency multiplication during the vertical retrace period BAV are shown in FIG. 3. As FIG. 3 shows, the doubly display state appearing in the screen is avoided.

Figure 4:
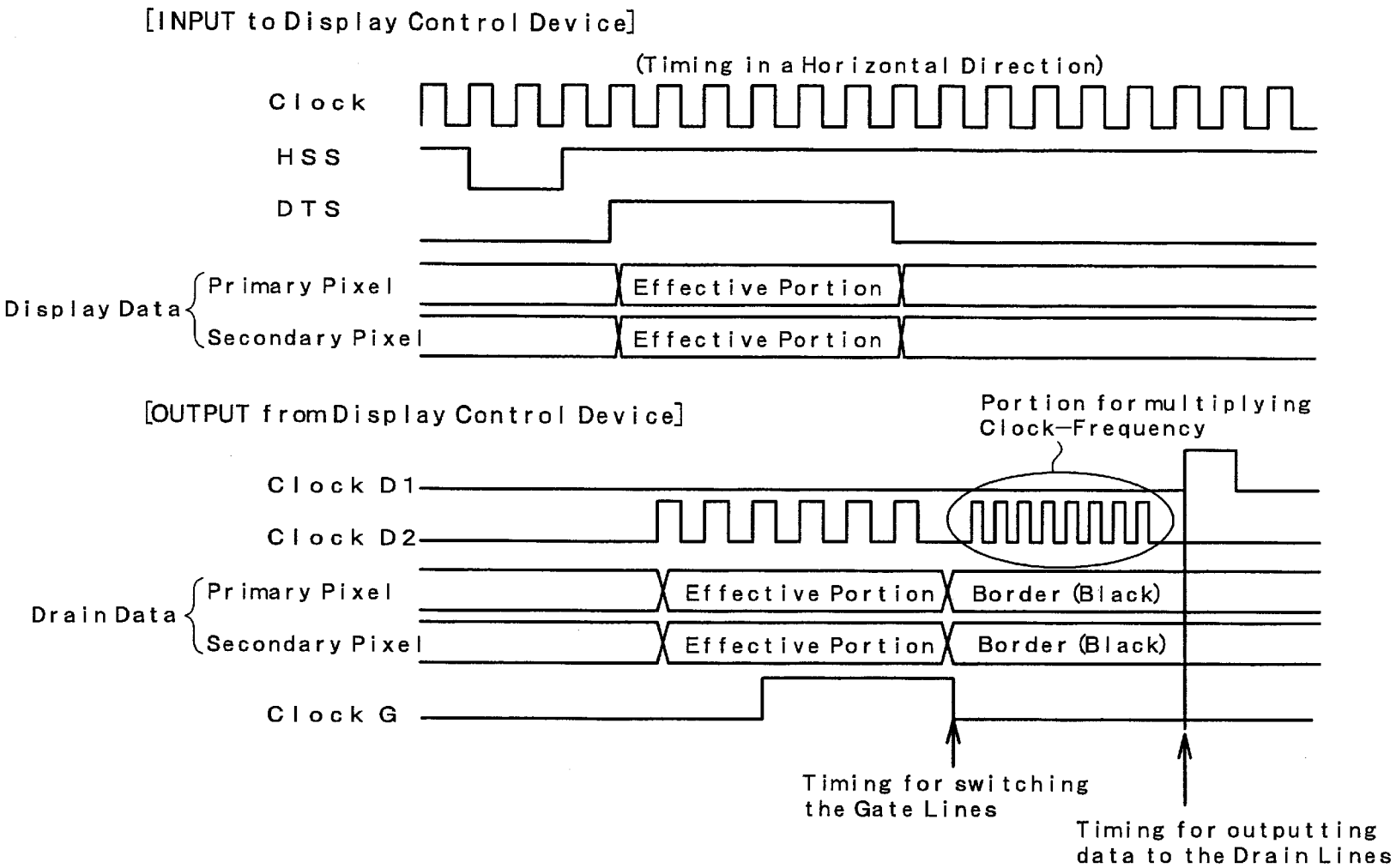
FIG. 4 is an explanatory diagrams showing driving timings in a horizontal direction of the display control device performing the display operation of FIG. 3.
Figure 5:
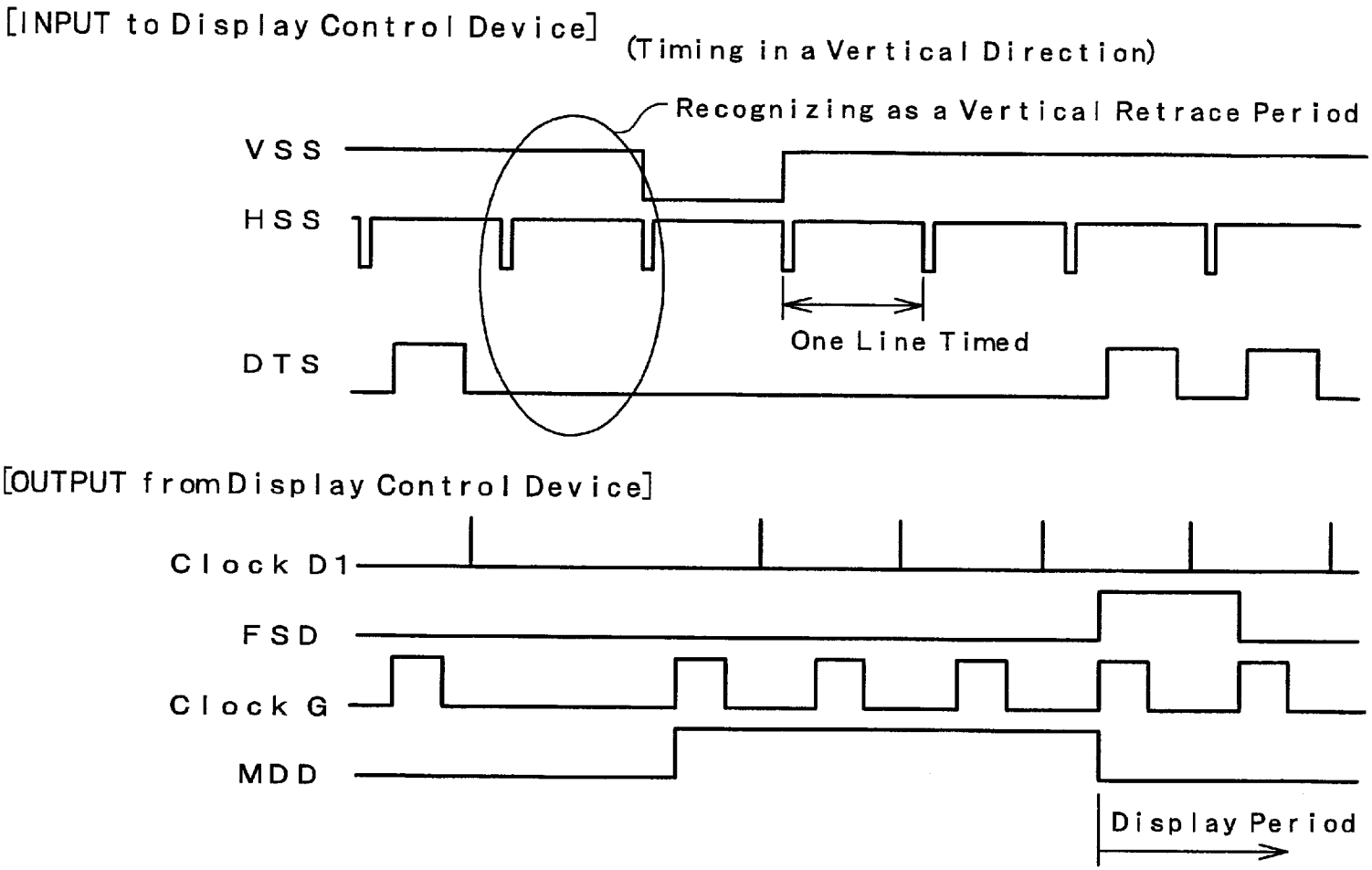
FIG. 5 is an explanatory diagrams showing driving timings in a vertical direction of the display control device performing the display operation of FIG. 3.

FIGS. 4 and 5 are explanatory diagrams showing driving timings of the display control device performing the display operation of FIG. 3. FIG. 4 shows a driving timing (signal waveforms applied) in the horizontal direction of the liquid crystal display panel, and FIG. 5 shows a driving timing (signal waveforms applied) in the vertical direction thereof, respectively.

In the driving timing in the horizontal direction shown in FIG. 4, clock signals (reference clocks, denoted by "Clock"), horizontal synchronizing signals (line synchronizing signals) HSS, display timing signals DTS, display data for the primary pixel, and display data for the secondary pixel are inputted from the main frame of the computer to the display control device.

In reference to these inputted signals and by the aforementioned circuitry configuration shown in FIG. 2, the clock signals D1, D2, a pair of the (drain) data, the clock signal (G) are outputted to the drain drivers. By a clock frequency multiplied portion of the waveform of the clock D2, the border color (black) is displayed in the screen of the liquid crystal display panel.

On the other hand, in the driving timing in the vertical direction shown in FIG. 5, the display control device outputs the clock signals D1, the frame starting direction signals FSD, the clock G, and the multi-line driving direction signals MDD with reference to the vertical synchronizing signals (the frame synchronizing signals) VSS, the horizontal synchronizing signals (line synchronizing signals) HSS, and the display timing signals DTS.

On recognizing a vertical retrace period by detecting both signal falls of the vertical synchronizing signal VSS and the horizontal synchronizing signal HSS during the certain one line time, a black displaying status is kept until a time at which the multi-line driving direction signal MDD falls.

In accordance with the driving timings of FIGS. 4 and 5, the displayed image avoiding the doubly displaying shown in FIG. 3 is obtained.

Figure 6:
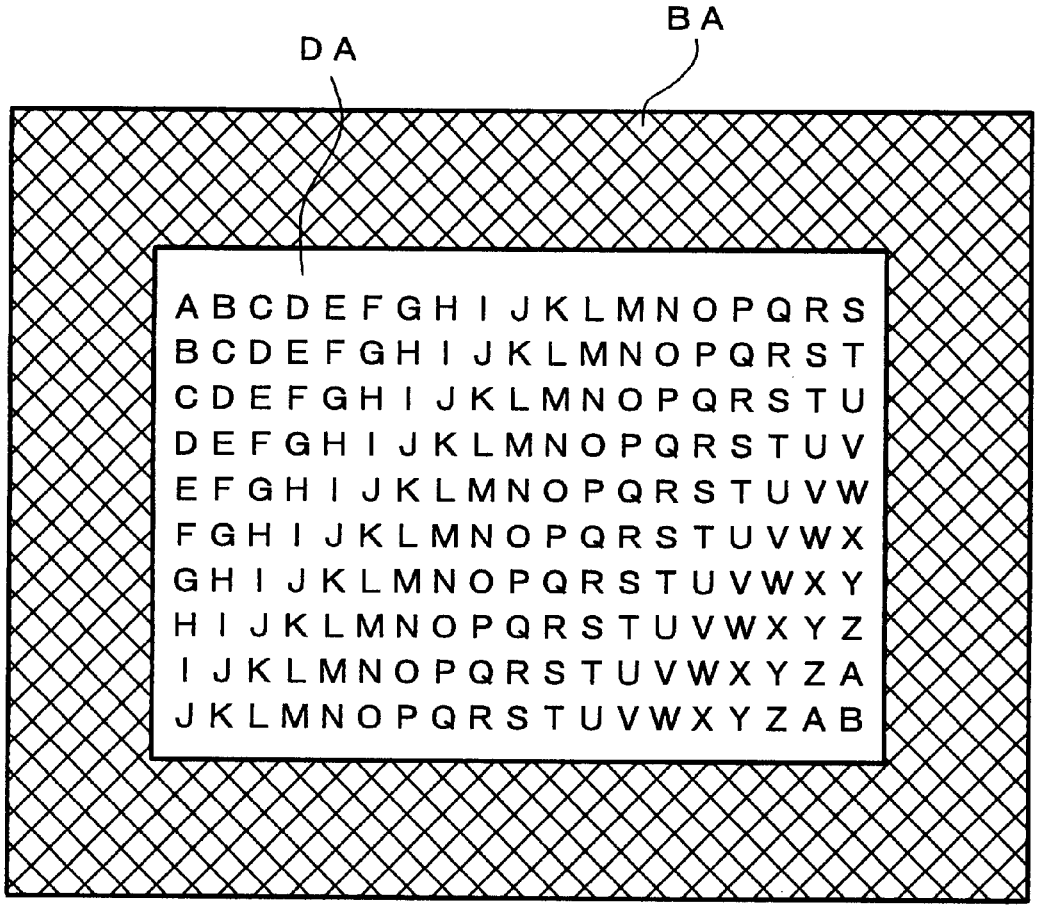
FIG. 6 is an explanatory drawings showing another example of contents being displayed in a screen of the liquid-crystal display panel based on the processing of the embodiment of the present invention.

Moreover, a display area DA is not only displayed at an upper left portion of the screen but can be displayed at a central portion thereof as FIG. 6 shows by moving the display area to the central portion thereof.

Figure 7:
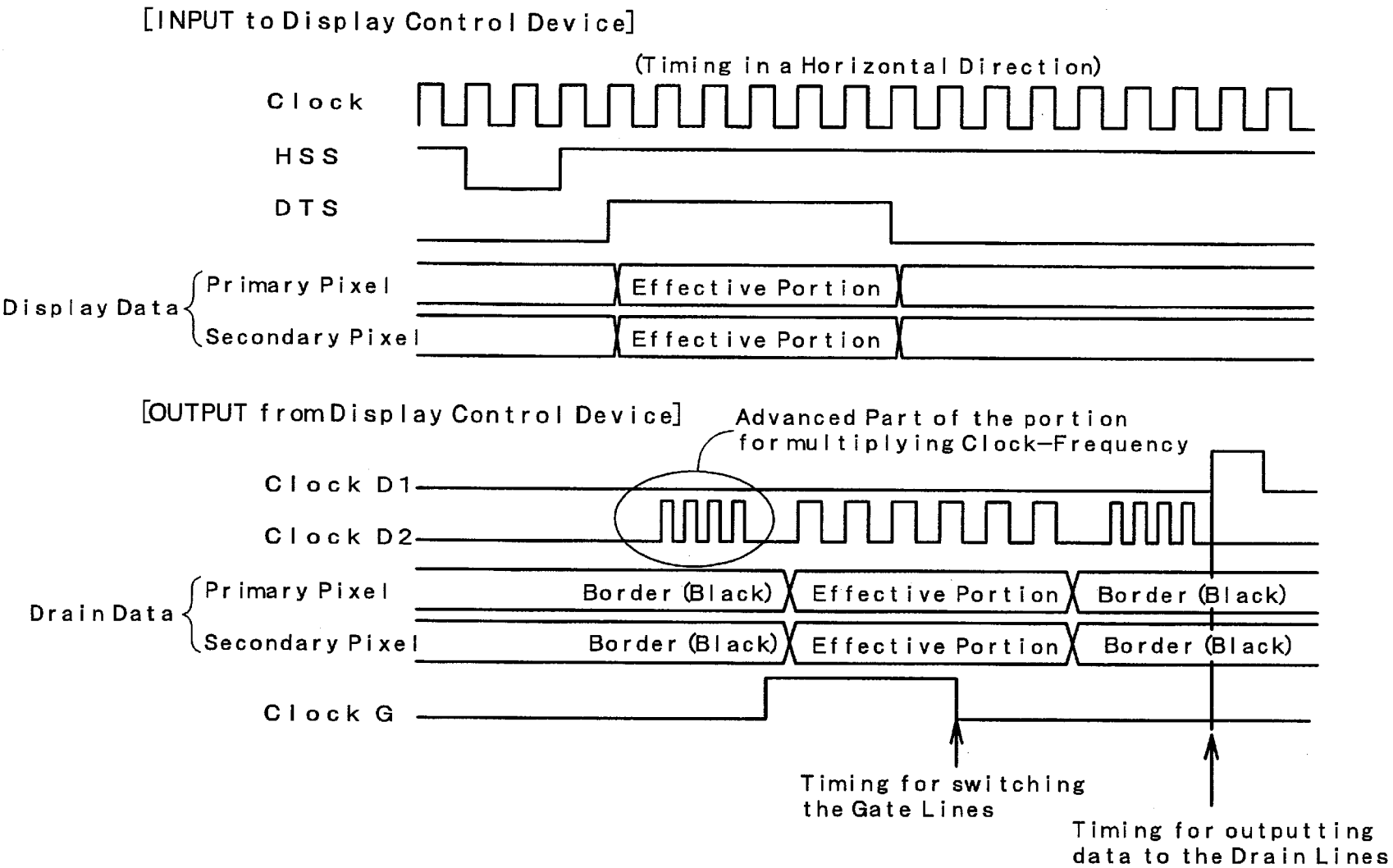
FIG. 7 is an explanatory diagram showing driving timings in a horizontal direction for locating the display area at the central portion of the screen.
Figure 8:
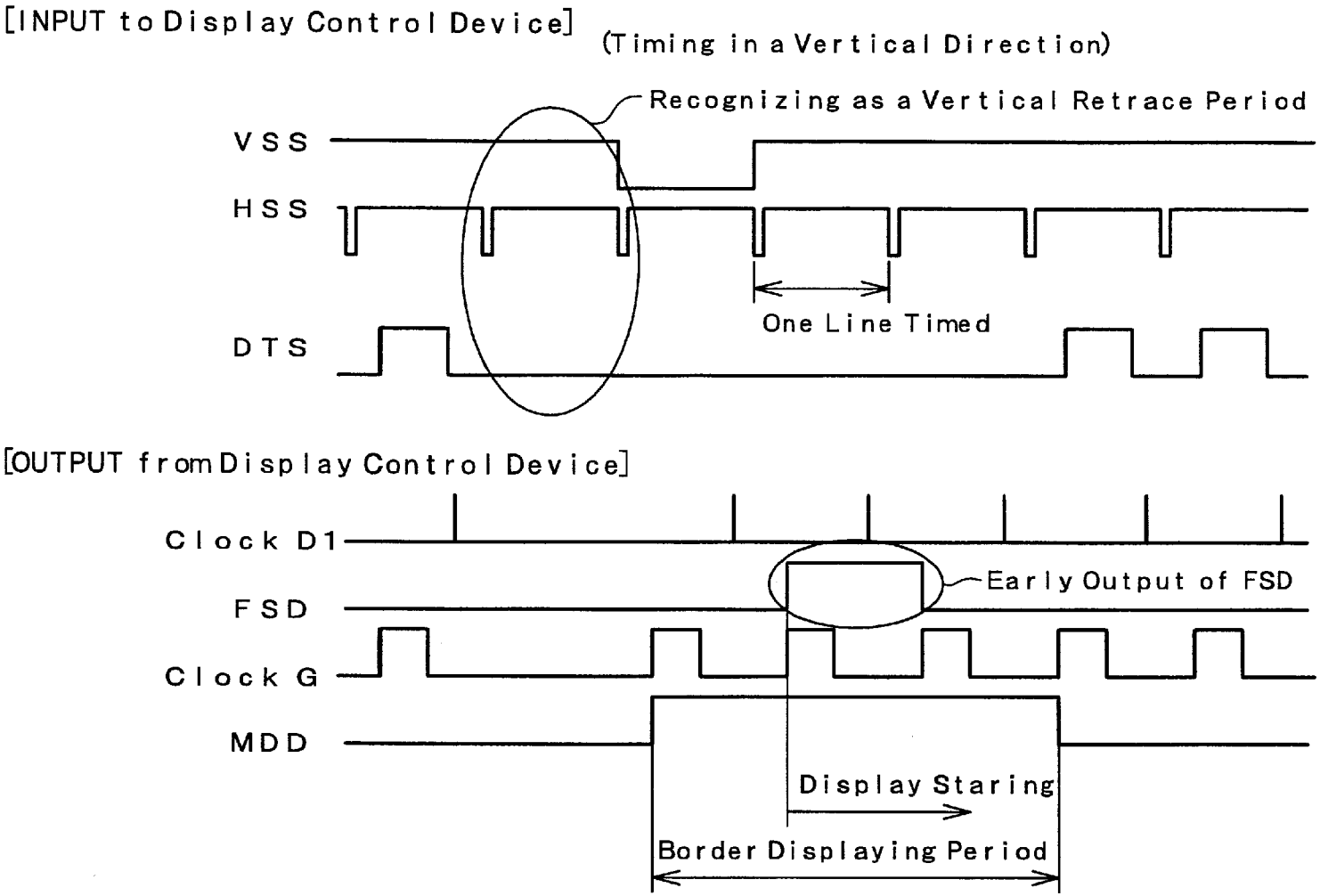
FIG. 8 is an explanatory diagram showing driving timings in a vertical direction for locating the display area at the central portion of the screen.

FIGS. 7 and 8 arc explanatory diagram showing driving timings for locating the display area DA at the central portion of the screen. FIG. 7 shows the driving timing in the horizontal direction, and FIG. 8 shows the driving timing in the vertical direction, respectively.

As FIG. 7 shows, the input signals to the display control device are the same as those of FIG. 4, but a part of the clock frequency multiplied portion of the waveform of the clock D2 is advanced before the effective periods of the drain data waveforms for both the primary pixel and the secondary pixel for displaying the image so as to supply the black displaying data to the drain drivers prior to the display data.

As for the vertical direction, the input signals to the display control device are the same as those of FIG. 5, but the frame starting direction signal FSD as one of the output signal thereof is outputted earlier than that of FIG. 5 so as to display a black area prior to the display data.

In accordance with such timings mentioned above, the display area DA can be located at the central potion of the screen.

According to the present embodiment, the multi-scanning processing of the liquid crystal display device is enabled without employing the complicated circuitry using memory device or the like.

Figure 9:
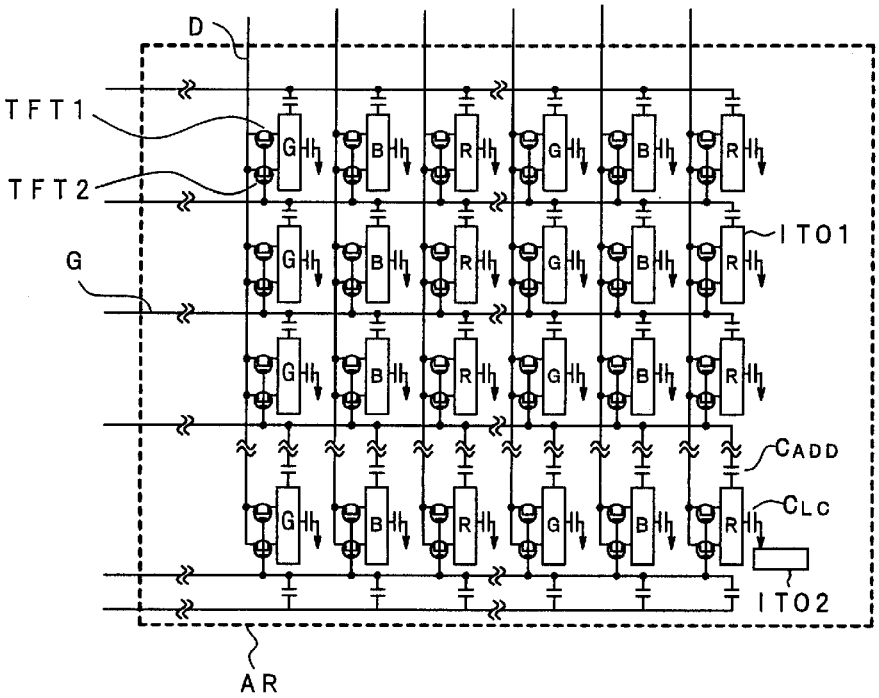
FIG. 9 is an equivalent circuit diagram for explaining an example of the pixel area in the liquid crystal display panel constituting the liquid crystal display device according to the present invention.

Another configuration of the liquid crystal display device is explained next. FIG. 9 shows an equivalent circuit for explaining an example of the pixel area in the liquid crystal display panel constituting the liquid crystal display device according to the present invention. FIG. 9 is drawn corresponding to the actual geometric arrangement of the pixel, and each of a plurality of pixels being arranged in a matrix manner in an effective display region (pixels area) AR is constituted of a pair of thin film transistors TFT1, TFT2.

A sign D denotes a drain signal line, and a sign G denotes a gate signal line, respectively. Each rectangle marked with R, G, or B shows each of pixel electrodes being provided in respective pixels of Red, Green, and Blue, and each pixel electrode is formed of an Indium-Tin-Oxide film ITO1. On the other hand, a sign ITO2 denotes a counter electrode (a common electrode), a sign $C_{LC}$ denotes an liquid crystal capacitance showing a liquid crystal layer equivalently, and a sign $C_{ADD}$ denotes an additional capacitance being formed between a source electrode of a thin film transistor and a gate signal line connected to another thin film transistor disposed prior to the thin film transistor.

Figure 10:
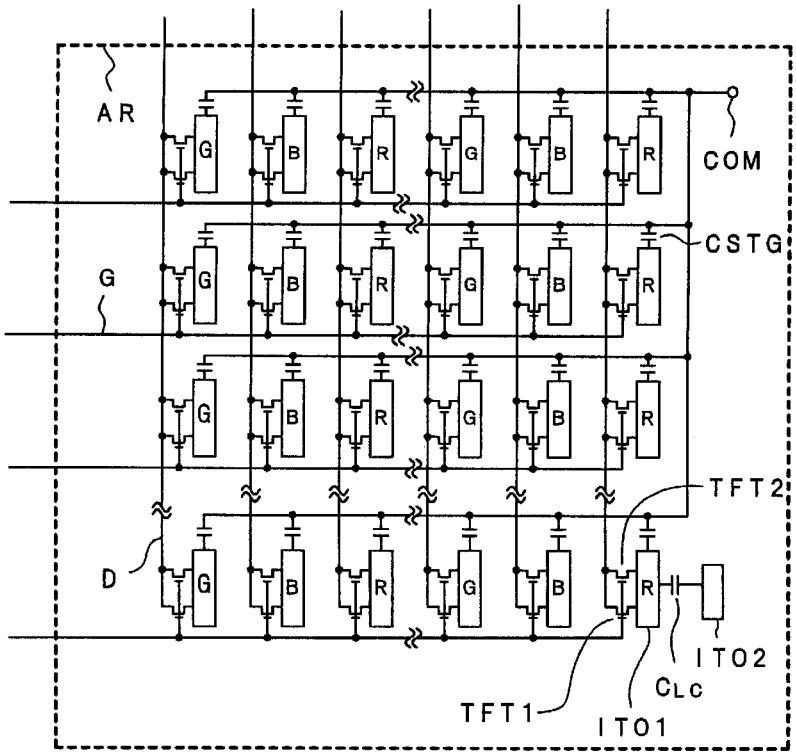
FIG. 10 is an equivalent circuit diagram for explaining another example of the pixel area in the liquid crystal display panel constituting the liquid crystal display device according to the present invention.

FIG. 10 shows an equivalent circuit for explaining another example of the pixel area in the liquid crystal display panel constituting the liquid crystal display device according to the present invention. FIG. 10 is also drawn corresponding to the actual geometric arrangement of the pixel, and each of a plurality of pixels being arranged in a matrix manner in an effective display region (pixels area) AR is constituted of a pair of thin film transistors TFT1, TFF2 as well as that shown in FIG. 9.

In FIG. 10 as well as FIG. 9, a sign D denotes a drain signal line, a sign G denotes a gate signal line, respectively, each rectangle marked with R, G, or B denotes each of pixel electrodes being provided in respective pixels of Red, Green, and Blue, a sign ITO2 denotes a counter electrode (a common electrode), and a sign $C_{LC}$ denotes an liquid crystal capacitance showing a liquid crystal layer equivalently, respectively. The configuration of FIG. 10 differs from that of FIG. 9 in a storage capacitor $C_{STG}$ being formed between a common signal line COM and a source electrode of a thin film transistor in FIG. 10 in place of the additional capacitance being formed between the source electrode and a gate signal line connected to another thin film transistor disposed prior to the thin film transistor.

In the aforementioned liquid crystal display panel shown in FIGS. 9 and 10, respective drain electrodes of the pair of thin film transistor TFT1, TFT2 in each of pixels arranged in a column direction thereof are connected to a drain signal line D. Each of the drain signal lines D is connected to one of drain drivers (being juxtaposed e.g. at upper side of the effective display region AR in the drawing) for applying voltages of the display data to the pixels arranged in the column direction corresponding thereto.

On the other hand, respective gate electrodes of the pair of thin film transistor TFT1, TFT2 in each of pixels arranged in a row direction of the liquid crystal display panel are connected to a gate signal line G. Each of the gate signal lines G is connected to one of gate drivers (being juxtaposed e.g. at left side of the effective display region AR in the drawing) for supplying scanning driver voltages (positively or negatively biased voltages) to respective gates of the pair of the thin film transistors TFT1, TFT2 corresponding thereto.

The present invention can be applied to the liquid crystal display devices using the liquid crystal display panel having either configuration of FIG. 9 or FIG. 10. The liquid crystal display panel having the latter circuitry (shown in FIG. 10) is preferable for enabling better displaying performance because a signal pulse of a gate signal line G connected a thin film transistor hardly jumps into a pixel electrode ITO1 connected to another thin film transistor arranged next to the thin film transistor, while the signal pulse is able to jump from the gate signal line into the pixel electrode via an additional capacitor $C_{ADD}$ in the liquid crystal display panel having the former circuitry (shown in FIG. 9).

Figure 11:
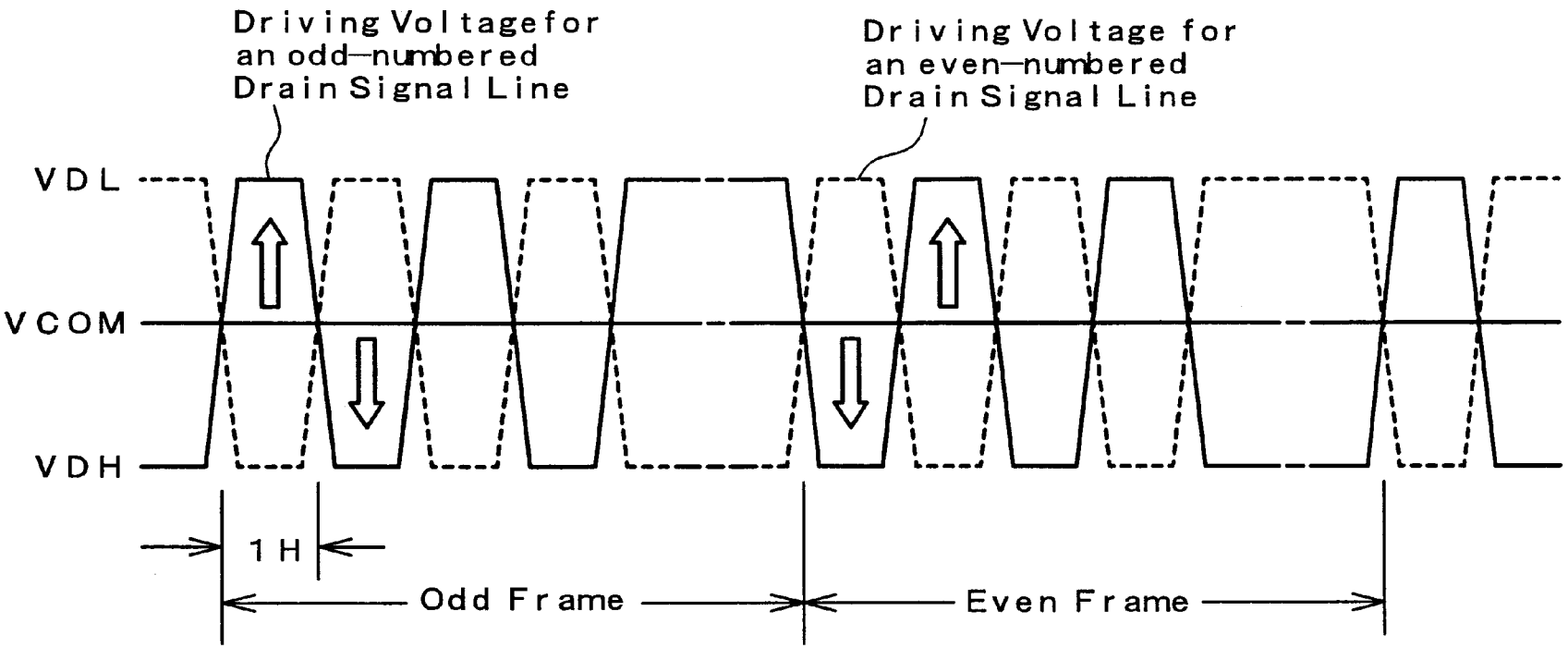
FIG. 11 is a timing diagram for explaining relationship between a liquid crystal driving voltage being outputted from the drain drivers to the drain signal lines (i.e. being applied to pixel electrodes ITO1) and another liquid crystal driving voltage being applied to a common electrode ITO2, in detail.

FIG. 11 is a timing diagram for explaining relationship between a liquid crystal driving voltage being outputted from the drain drivers to the drain signal lines (i.e. being applied to pixel electrodes ITO1) and another liquid crystal driving voltage being applied to a common electrode ITO2, in detail. The liquid crystal driving voltage being outputted from the drain drivers to the drain signal lines in FIG. 11 is drawn as a voltage for displaying a black area in a displaying screen of the liquid crystal display panel.

As FIG. 11 shows, a potential difference between the liquid crystal driving voltage VDH outputted from the drain drivers to an odd-numbered drain signal line D and the another liquid crystal driving voltage VCOM applied to the common electrode ITO2 indicates a reversed polarity of another potential difference between the liquid crystal driving voltage VDL outputted from the drain drivers to an even-numbered drain signal line D and the another liquid crystal driving voltage VCOM. For example, if the liquid crystal driving voltage VDH outputted to the odd-numbered drain signal line D indicates a positive polarity (or, a negative polarity) compared with the another liquid crystal driving voltage VCOM, the liquid crystal driving voltage VDL outputted to the even-numbered drain signal line D indicates a negative polarity (or, a positive polarity) compared with the another liquid crystal driving voltage VCOM.

Each polarity of the liquid crystal driving voltages VDH, VDL is reversed with respect to the another liquid crystal driving voltage VCOM for every one line (1H), and each polarity thereof for every one line is reversed for every frame period. By a dot inversion method performed in such a manner, as voltages applied to the drain signal lines D disposed adjacent to each other have reversed polarities to each other, an electrical power consumption can be reduced by canceling currents flowing the common electrodes ITO2 or the gate signal lines G disposed adjacent to each other.

Moreover, as a current amount flowing into the common electrode ITO2 remains so few as to prevent voltage thereof from increasing, a voltage level thereof is so stabilized that deterioration of the display quality can be suppressed to a minimum.

Figures 12A, 12B, 12C, 12D, 12E:
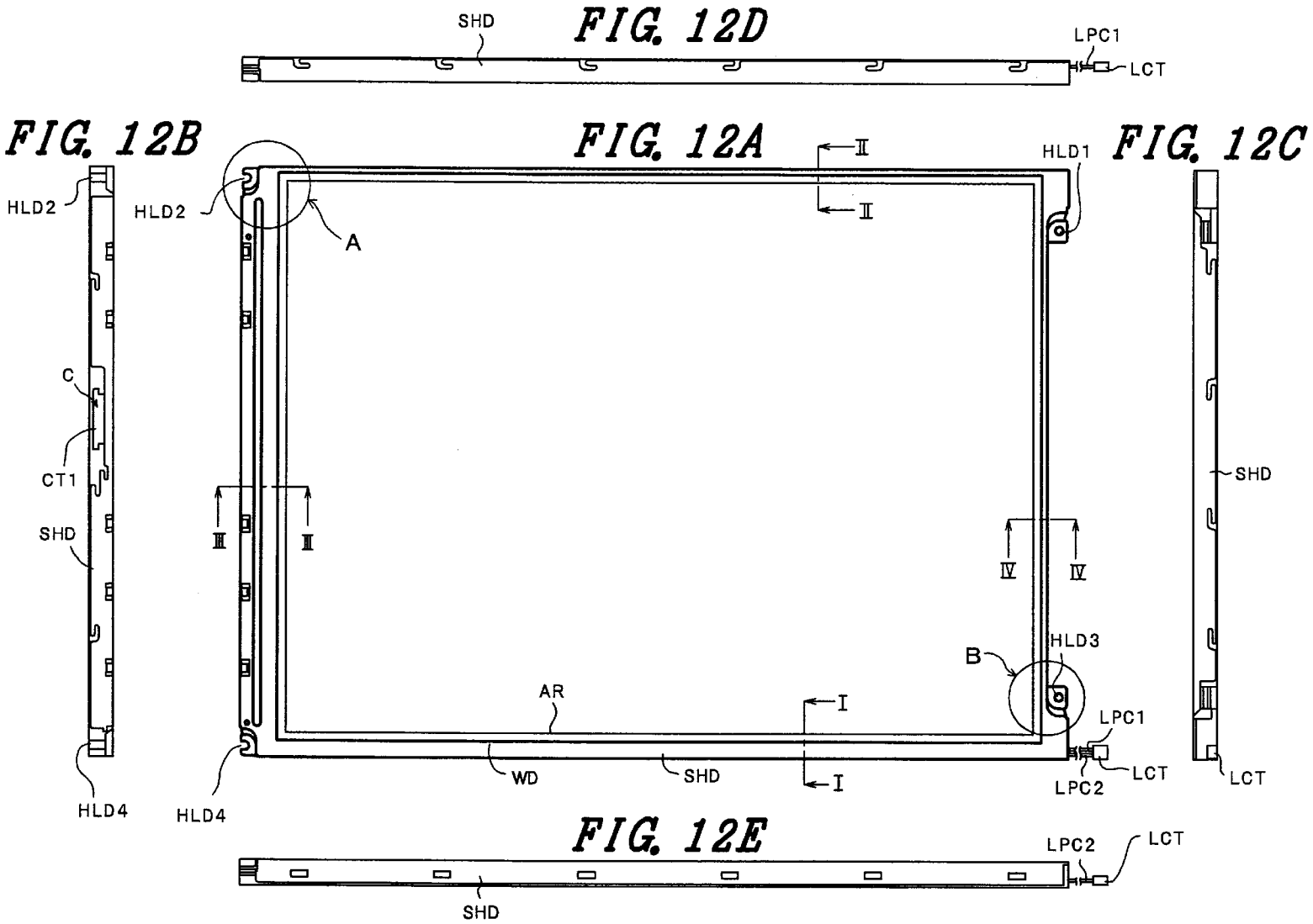
FIGS. 12A–12E are as-assembled drawings for explaining a configuration example of the liquid crystal display device according to the present invention.
Figure 13:
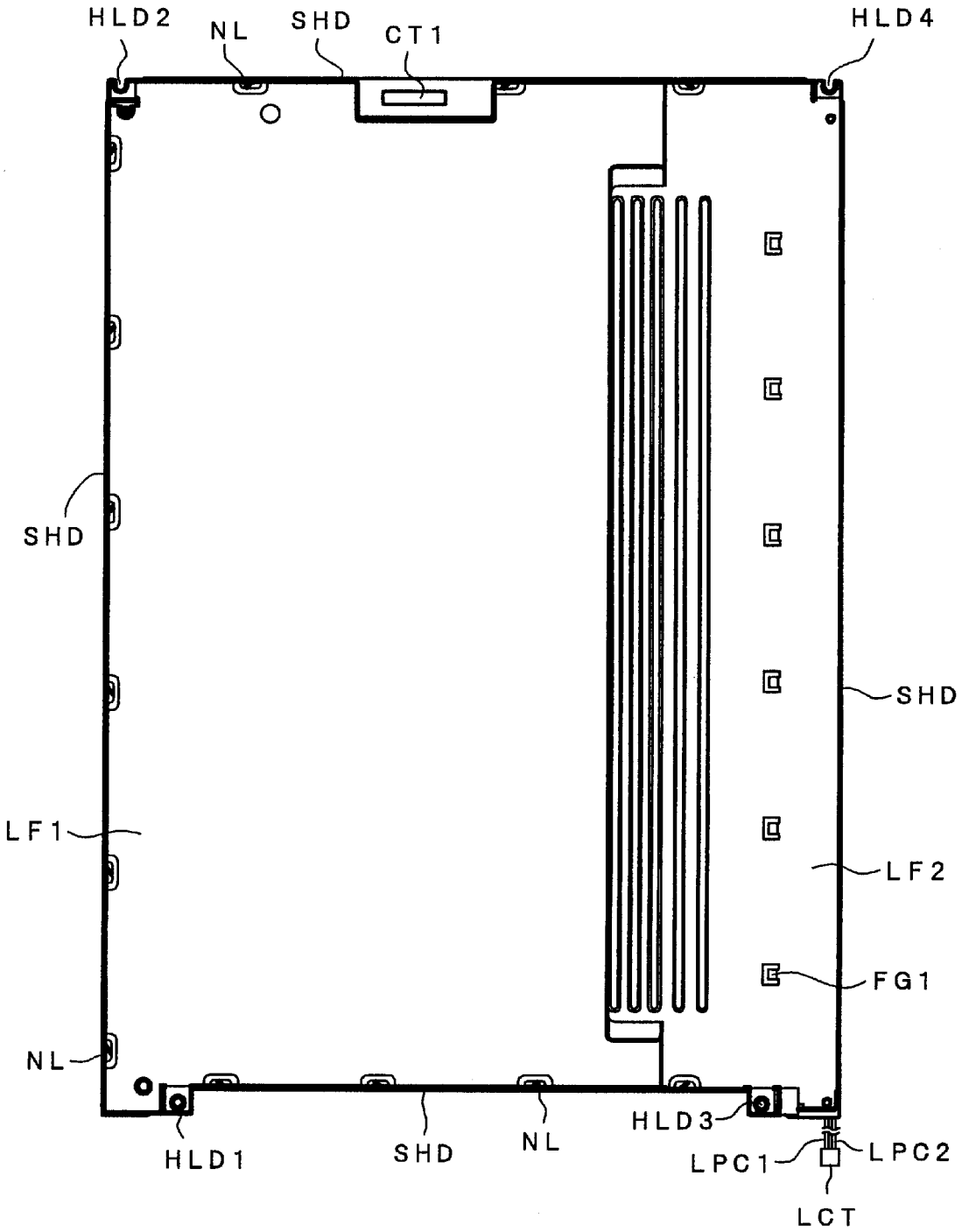
FIG. 13 is a rear view of the liquid crystal display device shown in FIGS. 12A–12E viewing at the rear side thereof.

FIGS. 12A–12E arc as-assembled drawings for explaining a configuration example of the liquid crystal display device according to the present invention, and FIG. 12A shows a front view thereof, FIG. 12B shows a left side view thereof, FIG. 12C shows a right side view thereof, FIG. 12D shows an upper side view thereof, and FIG. 12E shows a lower side view thereof, respectively. FIG. 13 is a rear view of the liquid crystal display device shown in FIGS. 12A–12E viewing at the rear side thereof.

As FIGS. 12A–12E and FIG. 13 show, the liquid crystal display device being integrated with a mold case ML and a shield case SHD as a whole is also called as a liquid crystal display module. The liquid crystal display module is mounted to an apparatus of a note-book type personal computer or the like by mounting holes HLD1, HLD2, HLD3, and HLD4 formed at both the mold case ML and the shield case SHD.

A back lighting unit for illuminating the liquid crystal display panel is housed inside an edge of the liquid crystal display module at a long side thereof. An inverter circuit unit is provided at a setback portion (a depressed portion) formed between the mounting holes HLD1, HLD2, and supplies a driving voltage to a fluorescent tube constituting the back lighting unit via a connector LCT, and lamp cables LPC1, LPC2.

The display data, the control signals, and the electric power source from the main frame of the computer arc supplied to the interface board via an interface connector CT1 being located at the rear side of the liquid crystal display device.

A frame area of the liquid crystal display module which does not contribute for displaying operation thereof is small, although an external size and an effective displaying area thereof are larger than those of a liquid crystal display panel of a SVGA-class displaying mode. Therefore, by mounting this liquid crystal display module in an apparatus like a notebook type personal computer, the apparatus can obtain a clear and wide display screen without spoiling portability thereof.

Figure 14B:
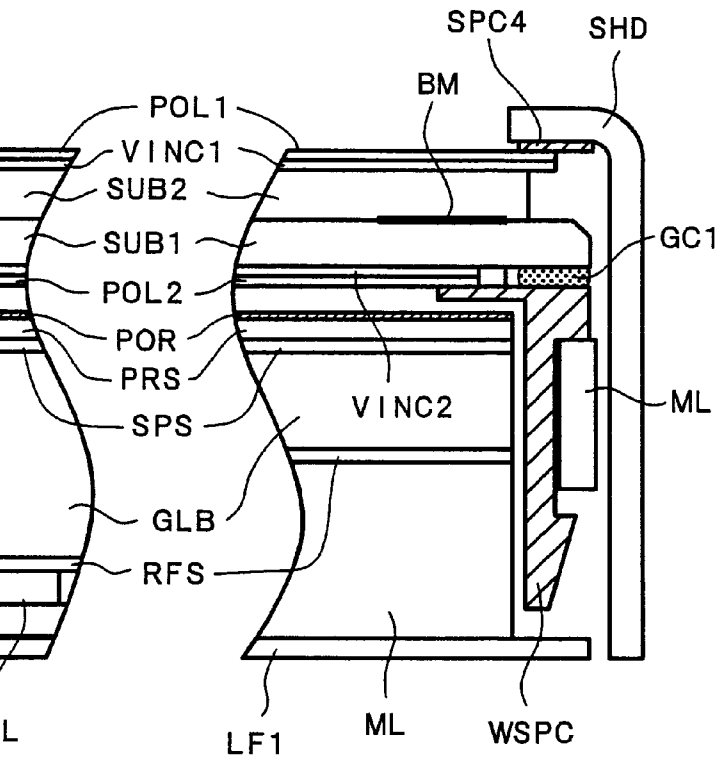
FIGS. 14A and 14B are cross-sectional views of the liquid crystal display module shown in FIGS. 12A–12E.
Figure 14A:
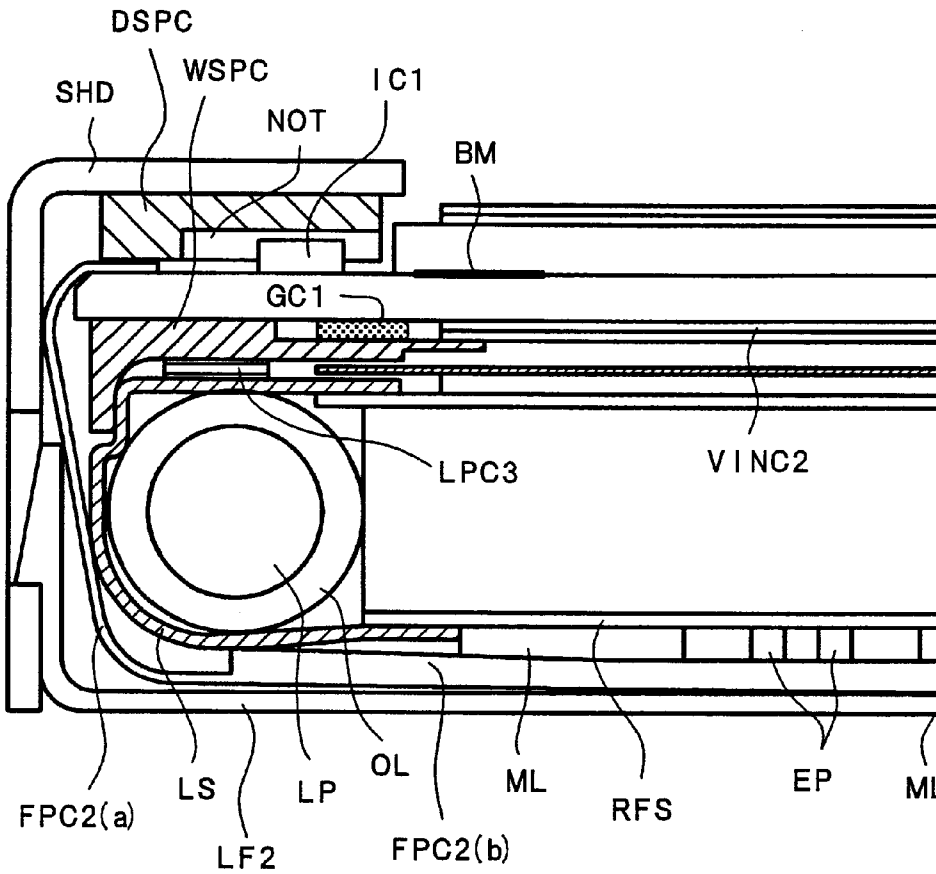
Figures 15A, 15B:
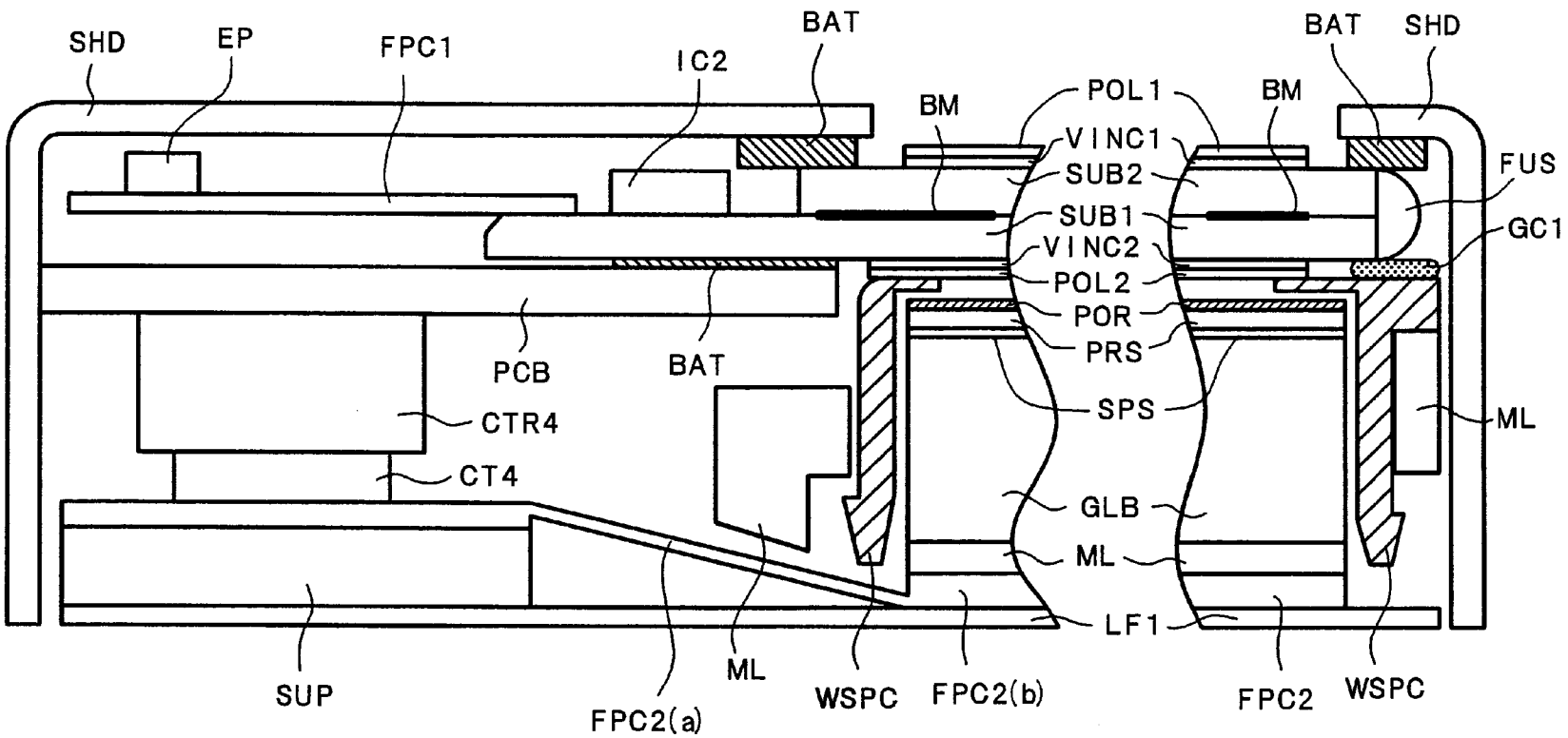
FIGS. 15A and 15B are cross-sectional views of the liquid crystal display module shown in FIGS. 12A–12E.

FIGS. 14A, 14B, 15A and 15B are cross-sectional views of the liquid crystal display module shown in FIGS. 12A–12E. FIG. 14A shows a cross-section taken along a line I—I in FIG. 12A, FIG. 14B shows a cross-section taken along a line II—II in FIG. 12A, FIG. 15A shows a cross-section taken along a line III—III in FIG. 12, and FIG. 15B shows a cross-section taken along a line IV—IV in FIG. 12A, respectively. In FIGS. 14A, 14B, 15A, and 15B, signs LF1 and LF2 denote a first lower shield case and a second lower shield case both of which cover the mold case ML, respectively.

A sign WSPC denotes a frame spacer for covering a periphery of the back lighting unit. A pair of glass substrates SUB1, SUB2 constitute the liquid crystal display panel, a thin film transistor TFT and a pixel electrode ITO1 are formed on one of the pair of glass substrates SUB1, and a color filter and a common electrode ITO2 are formed on another thereof SUB2.

A sign FUS denotes a sealing material, a sign BM denotes a light shielding film (a black matrix) being formed on the glass substrate SUB2, a sign POL1 denotes an upper polarizer, a sign POL2 denotes a lower polarizer, a sign VINC1 denotes a viewing field enlargement film (an optical retardation film) adhering to the glass substrate SUB2, and a sign VINC2 denotes a viewing field enlargement film (an optical retardation film) adhering to the glass substrate SUB1.

In this structure, contrast varying in accordance with a viewing angle at which a user of the liquid crystal display device views a screen thereof is compensated by the viewing field enlargement films adhering to the glass substrates SUB1, SUB2 so as to reduce a viewing angle dependence of the contrast. These viewing field enlargement films VINC1, VINC2 may be stuck outside the polarizers POL1 POL2, but a similar effect is available by disposing them between the glass substrate SUB1, SUB2, and the polarizer POL, POL2.

A sign LP denotes a fluorescent tube, a sign LS denotes a lamp reflector sheet, a sign GLB denotes a light guide plate, a sign RFS denotes a reflector sheet, and a sign SPS denotes a prism sheet, respectively. A polarizing reflector POR is provided for improving brightness of the liquid crystal display panel. The polarizing reflector POR has a property of transmitting light of a specific polarizing axis therethrough, but reflecting the other light of a polarizing axis other than the specific polarizing axis. Therefore, light a polarizing axis of which passes through the polarizing reflector POR but is absorbed by the lower polarizer POL2 is changed into a polarized light passing through the polarizing reflector POR while the light repeats to go and to return between the polarizing reflector POR and the light guide plate GLB, and then emitted from the polarizing reflector POR at the liquid crystal display panel side so that contrast of the liquid crystal display panel can be improved.

The frame spacer WSPC fixes the light guide plate GLB to the mold case ML by pressing down a peripheral portion of the light guide plate GLB by itself and to put hooks thereof into respective holes provided at the mold case ML, so that the light guide plate is prevented from hitting the liquid crystal display panel when any external shock is applied to the liquid crystal display module.

Moreover, the frame spacer WSPC also presses down the diffusing sheet SPS, the prism sheet PRS, and the polarizing reflector POR, so that the back lighting unit can be mounted in the liquid crystal display module without distorting the diffusing sheet SPS, the prism sheet PRS, and the polarizing reflector POR.

A rubber cushion GC1 is provided between the frame spacer WSPC and the glass substrate SUB1. A lamp cable LPC3 for supplying a driving voltage to the fluorescent tube LP is formed of a flat cable so as to reduce a mounting space thereof, and is disposed between the frame spacer WSPC and the lamp reflector sheet LS. The lamp cable LPC3 is fixed together with the lamp reflector sheet LS to the liquid crystal display module using a double-sided adhesive tape, and can be replaced together with the lamp reflector sheet LS. Therefore, the fluorescent tube LP can be easily replaced because the lamp cable LPC3 need not to be removed from the lamp reflector sheet LS.

An O ring OL works as a cushion between the fluorescent tube LP and the lamp reflector sheet LS. The O ring is formed of a transparent synthetic resin material so as not to reduce luminescence brightness of the fluorescent tube LP. Moreover, the O ring is formed of an insulating material having low permittivity (dielectric constant) for preventing a high frequency current from leaking from the fluorescent tube LP. Furthermore, the O-ring OL works to prevent the fluorescent tube LP from hitting the light guide plate GLB.

A semiconductor integrated circuit (a semiconductor chip, or an IC) ICI constitutes the drain driver for supplying the display data to the drain signal lines D of the liquid crystal display panel, and is mounted on the glass substrate SUB1. Since the semiconductor integrated circuit IC1 is mounted only on one of sides (edges) of the glass substrate SUB1, a frame portion (a peripheral portion) of the glass substrates opposite to the one of side thereof can be reduced (narrower).

The fluorescent tube LP and the lamp reflector sheet LS are arranged by stacking on each other below a portion of the glass substrate SUB1 on which the semiconductor integrated circuit IC1 is mounted, so that the fluorescent tube LP and the lamp reflector sheet LS are housed inside the liquid crystal display module compactly.

A flexible printed circuit board at the gate signal lines side FPC1 is connected to external terminals formed on the glass substrate SUB1 by anisotropic conductive film, and supplies an electric power source and driving signals to the semiconductor integrated circuits IC2. A flexible printed circuit board at the drain signal lines side FPC2 is connected to external terminals formed on the glass substrate SUB1 by anisotropic conductive film, and supplies an electric power source and driving signals to the semiconductor integrated circuits IC1. Chip components EP of a resistor, a capacitor, or the like arc mounted on these flexible printed circuit boards FPC1, FPC2.

In the exemplified configuration, the flexible printed circuit board FPC2 is bent so as to cover the lamp reflector sheet LS therein (see, the portion FPC2(*a*)), and a part thereof is interposed between the mold case ML and the second lower shield case LF2 and is fixed at a rear side of the back lighting unit (see, the portion FPC2(*b*)). Therefore, a portion of the mold case ML is cut out for obtaining a housing space for the chip components mounted on the flexible printed circuit board.

A bent portion FPC2(*a*) of the flexible printed circuit board FPC2 is formed thinner in a thickness thereof, and one of end portions FPC2(*b*) thereof is formed thicker in the thickness thereof because the one of end portions thereof has a multi-layered wiring structure (also called, a multi-layered printed circuit board structure). The lower shielding case is constituted of the first shield case LF1 and the second shield case LF2, and the pair of the first and second shield cases are arranged so as to cover the rear side of the liquid crystal display module. According to a structure of this sort, the lamp reflector sheet LS is revealed by removing the second lower shielding case LF2 so that the fluorescent tube LP is replaced easily.

An interface board PCB on which the display control device, the power source circuit, and the phase-locked loop PLL are mounted is also formed of a multi-layered printed circuit board. The interface board PCB is stuck on the glass substrate SUB1 by a double-sided adhesive tape BAT below the flexible printed circuit board FPC1 so as to overlap therewith in order to reduce a frame region of the liquid crystal display panel, in this embodiment.

Connectors CTR3, CTR4 are provided at the interface board PCB, and the connector CTR4 is electrically connected to a connector of the flexible printed circuit board FPC2. Similarly, the connector CTR3 is electrically connected to a connector CT3 of the flexible printed circuit board FPC1.

Figures 16A, 16B:
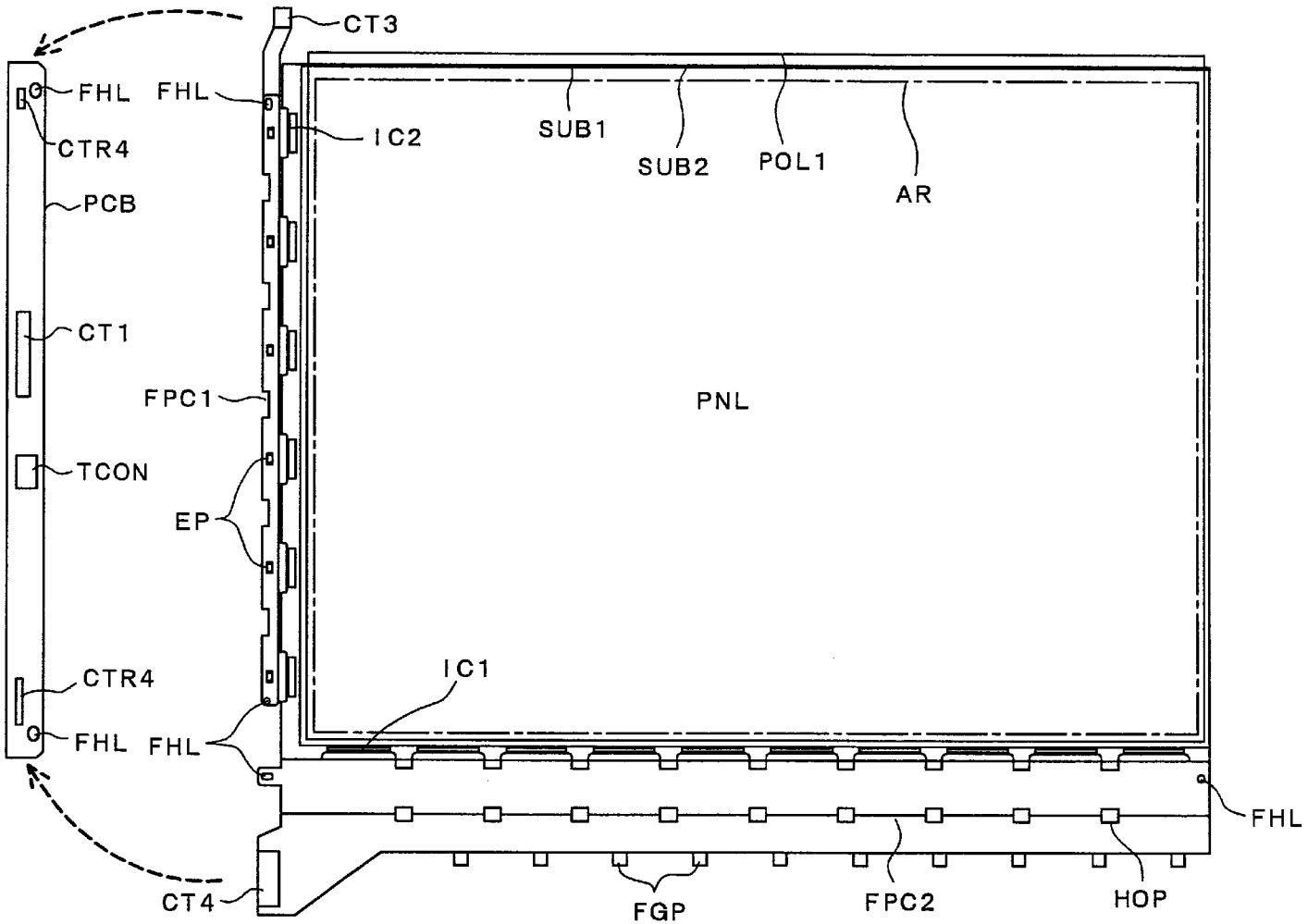
FIGS. 16A and 16B are explanatory drawings for explaining a configuration of the liquid crystal display panel on peripheries of which the flexible printed circuit boards are mounted.
Figure 17:
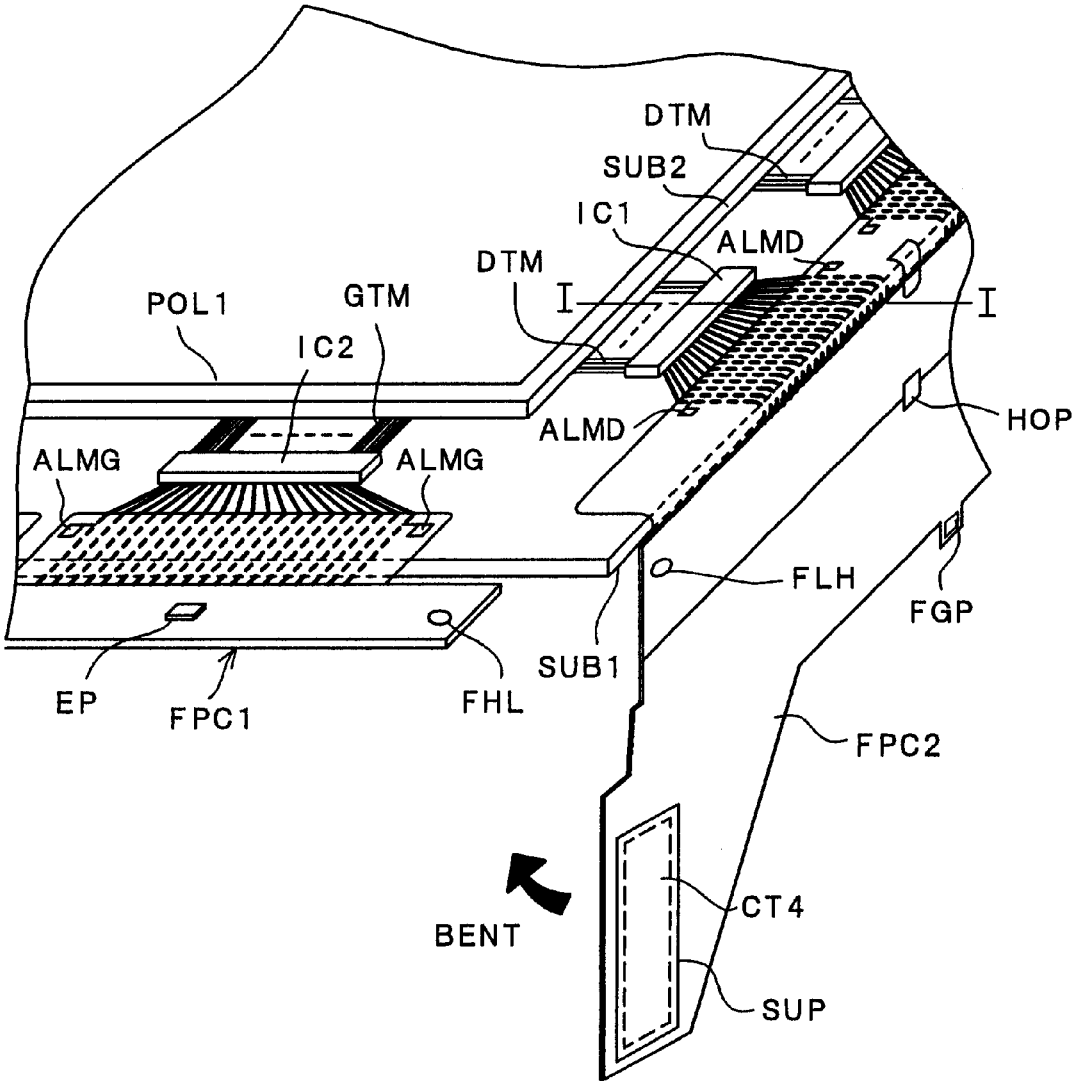
FIG. 17 is a squint view showing the printed circuit board of FIG. 16A and its vicinity for explaining a step for bending the printed circuit board.

FIGS. 16A and 16B are explanatory drawings for explaining a configuration of the liquid crystal display panel on peripheries of which the flexible printed circuit boards are mounted. FIG. 16A shows a lower side view of the liquid crystal display panel, and FIG. 16B shows a left side view thereof, respectively. FIG. 17 is a squint view showing the printed circuit board of FIG. 16A and its vicinity for explaining a step for bending the printed circuit board, and a sign TCON denotes a timing converter as one of the semiconductor integrated circuit constituting the display control device, a sign DTM denotes a drain terminal, and a sign GTM denotes a gate terminal, respectively.

A supporting board (a reinforcement) SUP is disposed between the lower shielding case LF1 and the connector CT4 so as to prevent the connector CT4 from being disconnected from the connector CTR4. A spacer SPC4 formed of nonwoven fabric (e.g. felt) is disposed between the shielding case SHD and the upper polarizer POL1, and stuck to the shielding case by an adhesive agent.

Both the upper polarizer POL1 and the viewing field enlargement film VINC1 are pull out partially from the glass substrate SUB2 so as to be pressed down by the shielding case SHD, in this embodiment. According to this structure, the liquid crystal display module can obtain sufficient strength, even if a frame region thereof is reduced.

A drain spacer DSPC (see, FIG. 14A) is disposed between the shielding case SHD and the glass substrate SUB1, and prevents the shielding case SHD from hitting the glass substrate SUB1. As a drain spacer DSPC is provided so as to cover the semiconductor integrated circuit (a semiconductor chip IC1), a portion of the drain spacer NOT in which the semiconductor chip IC will be located are notched (removed). According to the drain spacer DSPC having a notched portion NOT, the shielding case SHD and the drain spacer DSPC will not hit the semiconductor chip IC1.

Moreover, since the drain spacer DSPC presses down the flexible printed circuit board FPC2 disposed on the external connection terminals of the glass substrate SUB1, the flexible printed circuit board FPC2 is prevented from being exfoliated from the glass substrate SUB1. A sign FUS denotes a sealing material for sealing an opening of the liquid crystal display panel for filling liquid crystal compound therein.

The aforementioned liquid crystal display module uses the liquid crystal display device being constituted of the liquid crystal panel of so-called vertical electric field scheme (Twisted Nematic scheme, TN scheme), but the present invention is also able to be applied to the liquid crystal display panel of so-called lateral electric field scheme (In Plane Switching scheme, IPS-scheme) which has active elements, a pixel electrode, and a common electrode (a counter electrode) for composing a pixel being formed only on one of a pair of substrates thereof SUB1, and displays an image by generating electric fields in parallel with the one of the pair of substrates, similarly.

By the liquid crystal display module using the liquid crystal display device according to the present invention being constituted as a manner mentioned above, the liquid crystal display device displaying high definition images without any necessities for transferring the display data in a high transfer rate can be obtained.

As explained above, according to the present invention, in the case when a number of pixels of the display data inputted from the main frame of the computer or the like is smaller than a number of displaying pixels (in a effective display area) of the liquid crystal display panel, it is possible to provide the liquid crystal display device performing a multiple scanning processing by a simple configuration thereof without doubly displaying area appearing in a screen thereof.

While having shown and described several embodiments in accordance with the present invention, it is understood that the same is not limited thereto but is susceptible of numerous changes and modifications as known to those skilled in the art, and therefore the present invention is not limited to the details shown and described herein but covers all such changes and modifications as are encompassed by the scope of the appended claims.

What is claimed is:

1. A liquid crystal display device which comprises a liquid crystal display panel having a plurality of pixels formed in a matrix manner, a plurality of drain drivers for applying voltages based on a plurality of display data corresponding to a group of the plurality of the pixels arranged in a lateral direction of the matrix respectively to the group of the pixels, and a plurality of gate drivers for applying a scanning voltage to each of another group of the plurality of the pixels arranged in a longitudinal direction of the matrix, comprising:

an interface board on which an interface circuit for generating displaying voltages to be applied to the plurality of the drain drivers and the plurality of the gate drivers in accordance with the plurality of the display data and a control signal supplied from an external circuit to the liquid crystal display device is installed in the liquid crystal display device, the interface circuit includes a counter for counting a number N of pixels of the display data being inputted from the external circuit during one horizontal period, a lateral pixel number generating circuit for generating a capacity number M of pixels arranged in a lateral direction of the liquid crystal display panel which defines a number of the image data acceptable in the lateral direction, a subtracting circuit for subtracting the number M from the number N, a pixels-number conversion circuit for converting the number N of pixels of the display data to that of the number M when the number M is greater than the number N, and a clock frequency multiplying circuit for multiplying a frequency CL of the clock signal supplied from the external circuit by a natural number of A being equal to or greater than 2, and the pixel data are transferred together with the clock signal having a frequency of A×CL obtained by multiplying the frequency CL by the number A to the drain drivers, when the number M is divisible by the number N and provides the number A as a quotient of the division, and when the number N of the pixel data constituting the image data are converted to the number M greater than the number N using the clock signal of the frequency multiplied A-times by the clock frequency multiplying circuit.

2. A liquid crystal display device which comprises a liquid crystal display panel having a plurality of pixels formed in a matrix manner, a plurality of drain drivers for applying voltages based on a plurality of display data corresponding to a group of the plurality of the pixels arranged in a lateral direction of the matrix respectively to the group of the pixels, and a plurality of gate drivers for applying a scanning voltage to each of another group of the plurality of the pixels arranged in a longitudinal direction of the matrix, comprising:

an interface board on which an interface circuit for generating displaying voltages to be applied to the plurality of the drain drivers and the plurality of the gate drivers in accordance with the plurality of the display data and a control signal supplied from an external circuit to the liquid crystal display device is installed in the liquid display device, the interface circuit includes a counter for counting a number N of pixels of the display data being inputted from the external circuit during one horizontal period, a lateral pixel number generating circuit for generating a capacity number M of pixels arranged in a lateral direction of the liquid crystal display panel which defines a number of the image data acceptable in the lateral direction, a subtracting circuit for subtracting the number M from the number N, a pixels-number conversion circuit for converting the number N of pixels of the display data to that of the number M when the number M is greater than the number N, and a clock frequency multiplying circuit for multiplying a frequency CL of the clock signal supplied from the external circuit by a natural number of A being equal to or greater than 2, and pixel data are transferred together with the clock signal having the frequency CL to the drain drivers, while the clock signal having a frequency of A×CL obtained by multiplying the frequency CL by the number A to the drain drivers for scanning the rest of pixels of a number being the number N subtracted from the number M of the liquid crystal display panel, when the number M is indivisible by the number N, and when the number N of the pixel data constituting the image data are converted to the number M greater than the number N using the clock signal of the frequency multiplied A-times by the clock frequency multiplying circuit.

3. A liquid crystal display device which comprises a liquid crystal display panel having a plurality of pixels formed in a matrix manner, a plurality of drain drivers for applying voltages based on a plurality of display data corresponding to a group of the plurality of the pixels arranged in a lateral direction of the matrix respectively to the group of the pixels, and a plurality of gate drivers for applying a scanning voltage to each of another group of the plurality of the pixels arranged in a longitudinal direction of the matrix, comprising:

an interface board on which an interface circuit for generating displaying voltages to be applied to the plurality of the drain drivers and the plurality of the gate drivers in accordance with the plurality of the display data and a control signal supplied from an external circuit to the liquid crystal display device is installed in the liquid crystal display device, the interface circuit includes a counter for counting a number N of pixels of the display data being inputted from the external circuit during one horizontal period, a lateral pixel number generating circuit for generating a capacity number M of pixels arranged in a lateral direction of the liquid crystal display panel which defines a number of the image data acceptable in the lateral direction, a subtracting circuit for subtracting the number M from the number N, a pixels-number conversion circuit for converting the number N of pixels of the display data to that of the number M when the number M is greater than the number N, and a clock frequency multiplying circuit for multiplying a frequency CL of the clock signal supplied from the external circuit by a natural number of A being equal to or greater than 2, and data for displaying a plain region are transferred together with the clock signal having a frequency of A×CL obtained by multiplying the frequency CL by the number A to the drain drivers, when the number M is indivisible by the number N and a product of the number N being multiplied by the number A is smaller than the number M, and when the number N of the pixel data constituting the image data are converted to the number M greater than the number N using the clock signal of the frequency multiplied A-times by the clock frequency multiplying circuit.

4. A liquid crystal display device which comprises a liquid crystal display panel having a plurality of pixels formed in a matrix manner, a plurality of drain drivers for applying voltages based on a plurality of display data corresponding to a group of the plurality of the pixels arranged in a lateral direction of the matrix respectively to the group of the pixels, and a plurality of gate drivers for applying a scanning voltage to each of another group of the plurality of the pixels arranged in a longitudinal direction of the matrix, comprising:

an interface board on which an interface circuit for generating displaying voltages to be applied to the plurality of the drain drivers and the plurality of the gate drivers in accordance with the plurality of the display data and a control signal supplied from an external circuit to the liquid crystal display device is installed in the liquid crystal display device, the interface circuit includes a counter for counting a number N of pixels of the display data being inputted from the external circuit during one horizontal period, a lateral pixel number generating circuit for generating a capacity number M of pixels arranged in a lateral direction of the liquid crystal display panel which defines a number of the image data acceptable in the lateral direction, a subtracting circuit for subtracting the number M from the number N, a pixels-number conversion circuit for converting the number N of pixels of the display data to that of the number M when the number M is greater than the number N, and a clock frequency multiplying circuit for multiplying a frequency CL of the clock signal supplied from the external circuit by a natural number of A being equal to or greater than 2, a number of pixel lines arranged in a longitudinal direction of the liquid crystal display panel is M0, a number of pixel lines of the display data being inputted to the interface circuit is N0, and the number M0 is greater than the number N0, and when A0 is a natural number equal to or greater than 2, the A0 rows of the pixel lines in the liquid crystal display panel from the first line to the A0-th line are scanned simultaneously during one line time, and next A0 rows of the pixel lines from the (A0+1)-th line to the 2A0-th line are scanned simultaneously during a next one line time, when the number M0 is divisible by the number N0 and provides the number A0 as a quotient of the division.

5. A liquid crystal display device which comprises a liquid crystal display panel having a plurality of pixels formed in a matrix manner, a plurality of drain drivers for applying voltages based on a plurality of display data corresponding to a group of the plurality of the pixels arranged in a lateral direction of the matrix respectively to the group of the pixels, and a plurality of gate drivers for applying a scanning voltage to each of another group of the plurality of the pixels arranged in a longitudinal direction of the matrix, comprising:

an interface board on which an interface circuit for generating displaying voltages to be applied to the plurality of the drain drivers and the plurality of the gate drivers in accordance with the plurality of the display data and a control signal supplied from an external circuit to the liquid crystal display device is installed in the liquid crystal display device, the interface circuit includes a counter for counting a number N of pixels of the display data being inputted from the external circuit during one horizontal period, a lateral pixel number generating circuit for generating a number M of pixels arranged in a lateral direction of the liquid crystal display panel which defines a number of the image data acceptable in the lateral direction, a subtracting circuit for subtracting the number M from the number N, a pixels-number conversion circuit for converting the number N of pixels of the display data to that of the number M when the number M is greater than the number N, and a clock frequency multiplying circuit for multiplying a frequency CL of the clock signal supplied from the external circuit by a natural number of A being equal to or greater than 2, a number of pixel lines arranged in a longitudinal direction of the liquid crystal display panel is M0, a number of pixel lines of the display data being inputted to the interface circuit is N0, and the number M0 is greater than the number N0, and the display data are scanned by every row of the pixel lines during a display period, and data for displaying a plain region are scanned by B lines simultaneously in the vertical retrace period so as to finish scanning of rows of a number being the number N0 subtracted from the number M0 of the pixel lines of the liquid crystal display panel within the vertical retrace period, when the number M0 is indivisible by the number N0 and provides the number B as a remainder of the division.

6. A liquid crystal display device which comprises a liquid crystal display panel having a plurality of pixels formed in a matrix manner, a plurality of drain drivers for applying voltages based on a plurality of display data corresponding to a group of the plurality of the pixels arranged in a lateral direction of the matrix respectively to the group of the pixels, and a plurality of gate drivers for applying a scanning voltage to each of another group of the plurality of the pixels arranged in a longitudinal direction of the matrix, comprising:

an interface board on which an interface circuit for generating displaying voltages to be applied to the plurality of the drain drivers and the plurality of the gate drivers in accordance with the plurality of the display data and a control signal supplied from an external circuit to the liquid crystal display device is installed in the liquid crystal display device, the interface circuit includes a counter for counting a number N of pixels of the display data being inputted from the external circuit during one horizontal period, a lateral pixel number generating circuit for generating a capacity number M of pixels arranged in a lateral direction of the liquid crystal display panel which defines a number of the image data acceptable in the lateral direction, a subtracting circuit for subtracting the number M from the number N, a pixels-number conversion circuit for converting the number N of pixels of the display data to that of the number M when the number M is greater than the number N, and a clock frequency multiplying circuit for multiplying a frequency CL of the clock signal supplied from the external circuit by a natural number of A being equal to or greater than 2, a number of pixel lines arranged in a longitudinal direction of the liquid crystal display panel is M0, a number of pixel lines of the display data being inputted to the interface circuit is N0, and the number M0 is greater than the number N0, and when C is a natural number equal to or greater than 2, the display data are scanned by every C rows of the pixel lines during a display period, and data for displaying a plain region are scanned by B lines simultaneously in the vertical retrace period so as to finish scanning of rows of a number being the number N0 subtracted from the number M0 of the pixel lines of the liquid crystal display panel within the vertical retrace period, when the number M0 is indivisible by the number N0 and a product of the number N multiplied by the number C is less than the number M.

* * * * *